US005489967A

United States Patent [19]

Sakagami et al.

[11] Patent Number: 5,489,967

[45] Date of Patent: Feb. 6, 1996

[54] METHOD AND APPARATUS FOR PRINTING IMAGES ON A STACK OF RECORDING SHEETS USING PRESSURE

[75] Inventors: Yusuke Sakagami; Kunihiro Inoue; Tadashi Shimizu; Tetsushi Takahashi; Tadaaki Hagata; Kazuhiko Sato, all of Suwa, Japan

[73] Assignee: Seiko Epson Corporation, Tokyo, Japan

[21] Appl. No.: 117,101

[22] PCT Filed: Nov. 20, 1993

[86] PCT No.: PCT/JP93/00058

§ 371 Date: Nov. 10, 1993

§ 102(e) Date: Nov. 10, 1993

[87] PCT Pub. No.: WO93/14446

PCT Pub. Date: Jul. 22, 1993

[30] Foreign Application Priority Data

| | | | |
|---|---|---|---|
| Jan. 20, 1992 | [JP] | Japan | 4-007720 |
| Jan. 20, 1992 | [JP] | Japan | 4-007721 |
| Mar. 2, 1992 | [JP] | Japan | 4-044476 |
| Mar. 30, 1992 | [JP] | Japan | 4-073767 |
| Mar. 30, 1992 | [JP] | Japan | 4-073768 |
| Mar. 30, 1992 | [JP] | Japan | 4-073769 |
| Mar. 30, 1992 | [JP] | Japan | 4-073770 |
| Sep. 1, 1992 | [JP] | Japan | 4-233826 |

[51] Int. Cl.[6] ..... G03G 15/22; B41M 5/00

[52] U.S. Cl. ..... 355/202; 355/277; 346/74.2; 347/110; 462/8; 503/201

[58] Field of Search ..... 355/202, 210, 355/277; 347/101, 110; 346/74.2; 503/200, 201; 462/8, 10, 25, 28, 29

[56] References Cited

U.S. PATENT DOCUMENTS

| | | | |
|---|---|---|---|
| 3,608,488 | 9/1971 | Levine | 346/74.2 X |
| 4,126,711 | 11/1978 | Marlow | 430/103 |
| 4,492,178 | 1/1985 | Voirin et al. | 118/657 |
| 5,017,961 | 5/1991 | Hasegawa | 355/202 |
| 5,212,040 | 5/1993 | Sanders et al. | 430/126 |

FOREIGN PATENT DOCUMENTS

| | | | |
|---|---|---|---|
| 50-60108 U | 6/1975 | Japan . | |
| 53-159335 U | 12/1978 | Japan . | |
| 55-113078 | 9/1980 | Japan . | |
| 57-189895 | 11/1982 | Japan . | |
| 59-9683 | 1/1984 | Japan . | |
| 4-339654 | 11/1992 | Japan | 347/101 |

*Primary Examiner*—Joan H. Pendegrass

*Attorney, Agent, or Firm*—Sughrue, Mion, Zinn, Macpeak & Seas

[57] ABSTRACT

In a magnetic printing apparatus wherein a demagnetizer 2 as a latent image eraser, a magnetic head 3 constituting a latent image former, a developer 4, a transfer roller 5, a fixer 6, and a cleaner 7 are disposed in this order around a latent image carrier 1, a recording paper 15 including a stack of plural sheets of carbonless paper is fed, transported, and discharged, a single-component dry toner 8 is used, and pressure transfer is made by a transfer roller 5 at a load per unit roller length of 5 kgf/cm or more, thereby achieving printing and copying.

37 Claims, 12 Drawing Sheets

METHOD AND APPARATUS FOR PRINTING IMAGES ON A STACK OF RECORDING SHEETS USING PRESSURE

TECHNICAL FIELD

This invention relates to a printing apparatus used as an output apparatus for a computer and the like, specifically to a printing method and apparatus for a stack of plural recording sheets which senses a pressure to achieve copying.

BACKGROUND ART

A typical conventional printing apparatus is an impact dot matrix type printing apparatus. As shown in FIG. 18, the impact dot matrix printing apparatus mainly comprises a print head 10, print wires 11, a carriage 12, a shaft 13, a fabric ribbon 14 and the like. The principle of printing is that when an electrical signal is applied to an actuator (not shown) in the print head 10, the print wire 11 connected to the actuator moves forward through a wire guide (not shown)to hit the fabric ribbon 14 and a recording paper 15, which causes ink in the fabric ribbon 14 to be transferred to the recording paper 15, thereby forming one pixel by each print wire. The print head 10, mounted on the carriage 12, can move smoothly on the shaft 13, the print wire 11 operates when the print head 10 comes at a predetermined position to form letters and the like. The actuator includes those of a plunger type, a pole type, a clapper type, a spring charge type, a moving coil type, a piezoelectric type, and the like. In general, actuators of the clapper type and the spring type are popularly used.

The recording paper 15 is of a type which a plurality of sheets are stacked and sense to a pressure to achieve copying. Normally, copying is possible by stacking a carbon paper called a pressure-sensitive paper or plural sheets of carbonless paper, and these are widely used for slips, receipts, and the like. Presently, the carbonless paper is predominantly used.

FIG. 19 shows a construction example of the recording paper 15 using the carbonless paper. In FIG. 19, the recording paper 15 comprises a top paper 16 positioned at the top, a bottom paper 18 positioned at the bottom, and necessary number of middle paper 17 positioned in the middle. The top paper 16 comprises a paper 19, which is a paper with a color former 20 coated on the back side, the middle paper 17 comprises a paper 19 with a color developer 21 coated on the surface and the color former 20 coated on the back side, and the bottom paper 18 comprises a paper 19 coated on the surface with the color developer 21. The color former 20 is an aggregate of microcapsules containing a dye, which opposes the color developer 21 and, when a load over a limit pressure is applied, the microcapsules at the portion are broken to release the dye, developing a predetermined color by a chemical reaction with the color developer 21. This is the principle of copying in the carbonless paper.

FIG. 20 shows a construction example of the recording paper 15 using carbon paper. One which is shown in FIG. 20(*a*) comprises a top paper 22, necessary sheets of a middle paper 23, and a bottom paper 24, the top paper 22 and the middle paper 23 are the same which are coated on the back side with a carbon layer 25 comprising a mixture of carbon and oil or wax. The bottom paper 24 is a paper and has no carbon layer. One which is shown in FIG. 20(*b*) comprises plural sheets of a paper 26 and a thin carbon paper 27 having the carbon layer 25 on the back side, which are inserted between the individual sheets. These recording paper 15 are the same as carbonless paper in that transfer is achieved by a pressure. Therefore, recording paper using the carbonless paper will be described below, which is also true for the carbon paper.

When two copies are required in addition to the original printed matter, the top paper 16, the middle paper 17, and the bottom paper 18 as shown in FIG. 19, for example, are stacked one sheet each in a predetermined order, and set on an impact dot matrix type printing apparatus so that they are pressurized by the print wire 11 from the upper side, thereby obtaining favorable copies. The number of copies achieved by the impact dot matrix type printing apparatus is normally 3 to 6 sheets. The number is 4 to 5 sheets for manuscript by a ball-point pen, and 6 to 10 sheets for an electric typewriter.

In addition to the impact dot matrix type, there are a thermal transfer type and an ink jet type, but any practical apparatus which enables copying is not yet available.

Therefore, with the recent increase in the information processing capacity by computers and needs for outputting large amounts of computer-processed information, slips and receipts requiring copying are going on increasing, however, copyable printing apparatus has been limited to that of impact dot matrix type.

However, the impact dot matrix type printing apparatus has a problem in that it generates high noise during printing which gives others an unpleasant feeling. That is, depending on the location of use, the printing apparatus is required to have a copying function and to be as low in noise as possible during printing, but the impact dot matrix type printing apparatus is not suitable for such applications.

To eliminate the above prior art problems, the primary object of the present invention is to provide a printing method and apparatus which has a copying function and is low in noise.

DISCLOSURE OF INVENTION

A first printing method according to the present invention uses a printing apparatus having the steps of latent image erasing, latent image formation, development, transfer, and fixing, in which at least two sheets of recording paper are stacked, fed, transported, and discharged, whereby achieving printing and copying. As necessary, development is carried out by a single-component dry developing method, and the toner has an average particle diameter of 30 to 150 μm. Transfer is achieved by a pressure transfer method with a transfer pressure of 5 kgf/cm or more in load per unit roller length. Furthermore, the transfer is achieved by an electrostatic transfer method, and a pressure mechanism is used to apply a load per unit roller length of 5 kgf/cm or more to the toner image on the recording paper, in addition to the transfer and fixing. The printing apparatus used in the printing method according to the present invention is that of non-impact type using a toner, including a typical electrophotographic printing apparatus, a magnetic printing apparatus, and an ion-flow printing apparatus. In these printing apparatuses, since the basic image formation process is the same, and each apparatus has the processes for latent image erasing, latent image formation, developing, fixing, and cleaning, the printing is low in noise, high in printing quality, and high in printing speed. That is, since the printing apparatus used in the present invention has no print wire as seen in the impact dot matrix printing apparatus, it has a reduced number of moving parts, and does not generate a high noise such as an impact noise by the print wire and the like. The principle of copying without a print wire is as follows. When two or more sheets of copyable recording paper are printed by such a printing apparatus, the toner undergoes plastic deformation to be adhered to the surface of the recording paper, thereby achieving transfer. Further, a pressure is applied to a part where the toner exists in the thickness direction of the recording paper, thereby achieving copying. In particular, a sharp print with no spotting can be obtained when developing is carried out by the single-component dry developing method, and the average particle diameter of the toner and the pressure applied to the recording paper are appropriately set.

A second printing method according to the present invention uses a printing apparatus having the steps of feeding, transporting, and discharging a stack of plural sheets of pressure-sensitive paper which develops a color by a reaction of a color developer and a dye in microcapsules, in addition to latent image erasing, latent image formation, development, transfer, and fixing, and uses a toner having a compressive strength greater than that of the microcapsules, whereby achieving printing and copying. In the second printing method, when the recording paper is applied with a pressure through the toner, the microcapsules are broken at a pressure lower than that of the toner, the dye comes out from the microcapsules and chemically reacts with the color developer to develop a color, thereby achieving copying.

The printing apparatus of the present invention is broadly divided into nine types.

A first printing apparatus comprises a latent image carrier, a latent image eraser for erasing a latent image on the latent image carrier, a developer for developing the latent image on the latent image carrier by an aggregate of toners, a transfer roller for transferring the image on the latent image carrier to copyable recording paper comprising a stack of plural sheets sensitive to a pressure to achieve copying, a fixer for fixing the image on the recording paper, and a cleaner for removing the toner remaining on the latent image carrier after pressure transfer, in a condition of $t/4 \leqq d \leqq t+a$, wherein d is a clearance between the latent image carrier and the transfer roller, t is a total thickness of the recording paper, and a is a height of the toner on the latent image carrier. Furthermore, as necessary, rings rotatable independent of the transfer roller are provided at both ends of the transfer roller, and a clearance is maintained between the latent image carrier and the transfer roller when the latent image carrier is in contact with the rings. Furthermore, the toner has a structure of at least two layers comprising a core part and a shell part, the core part has an elastic modulus higher than that of the shell part, and the latent image carrier and the transfer roller are formed of a substance having a Vickers hardness of 50 or more. Further, the core part of the toner is made of a magnetic substance, and the shell part is made of a resin. The height of the toner is 30 μm or more. A sprocket with projections disposed at predetermined intervals in the circumferential direction is provided at both ends of the transfer roller. The latent image carrier has a length smaller than the distance between both sprockets at both ends of the transfer roller. The latent image carrier is drum formed, with an outer diameter of both ends smaller than that of the central portion. The recording paper is a stack of plural sheets of pressure-sensitive paper which develops a color by a reaction of the color developer with the dye in the microcapsules, and the toner has a greater compressive strength than the microcapsules. The developer is a single-component dry developer. The transfer pressure in the pressure transfer is 5 kgf/cm or more in load per unit roller length.

The first printing apparatus is also of a non-impact type, including a magnetic printing apparatus, an ion-flow printing apparatus, and the like, in addition to the typical electrophotographic printing apparatus, has the same basic image formation processes including latent image erasing, latent image formation, development, transfer, fixing, and cleaning, and is thus low-noise, and high in print quality and printing speed. That is, since the printing apparatus has no print wire as seen in the impact dot matrix printing apparatus, it has a reduced number of moving parts, and does not generate a high noise such as an impact noise by the print wire and the like.

In the first printing apparatus, the transfer process is a type utilizing a pressure such as pressure transfer type or electrostatic pressure type, in which, by the pressure between the latent image carrier and the transfer roller, the toner on the latent image carrier undergoes plastic deformation to be adhered to the surface of the recording paper, thereby achieving transfer. Since, in this case, there is a relation of $t/4 \leqq d \leqq t+a$ among the total thickness t of the recording paper, the clearance d between the latent image carrier and the transfer roller, and the height a of the toner on the latent image carrier, the pressure at the part where the toner exists becomes greater than others, and the pressure is transmitted in the thickness direction of the recording paper through the toner, thereby achieving copying. In the first printing apparatus, the material of the latent image carrier and the transfer roller is harder at least than that of the toner, the recording agent, and the recording paper, thereby transmitting the pressure efficiently.

A second printing apparatus of the present invention comprises a latent image eraser for erasing a latent image on a latent image carrier, a latent image former for forming a latent image on the latent image carrier, a developer for developing the latent image on the latent image carrier to an image by an aggregate of toner, a transfer roller for transferring the image on the latent image carrier to copyable recording paper comprising a stack of plural sheets sensitive to a pressure, two pressure rollers for pressurizing the recording paper after transfer, a fixer for fixing the image on the recording paper, and a cleaner for removing the toner remaining on the latent image carrier after transfer, in a condition of $t/4 \leqq d \leqq t+a$ wherein d is a clearance between the two pressure rollers, t is a total thickness of the recording paper, and a is a height of the toner on the recording paper, and the recording paper is passed through the clearances between the latent image carrier and the transfer roller, and between the two pressure rollers. Furthermore, as necessary, the toner has at least a two-layered structure consisting of a core part and a shell part, the core part has a greater elastic modulus than that of the shell part, and the two pressure rollers are made of a material having a Vickers hardness of 50 or more. The core part of the toner is made of a magnetic material, and the shell part is made of a resin. The height a of the toner is 30 μm or more. A sprocket with projections disposed at predetermined intervals in the circumferential direction are provided at both ends of one of the pressure rollers. The length of the other pressure roller is shorter than the distance between the sprockets at both ends of the one pressure roller. The outer diameter of both ends of the other pressure roller is smaller than that of the central portion. The recording paper is a stack of plural sheets of pressure-sensitive paper which develops a color by a reaction of the color developer with the dye in the microcapsules, and the toner has a greater compressive strength than the microcapsules. The developer is a single-component dry developer. The pressure between the two pressure rollers is 5 kgf/cm or more in load per unit roller length.

The second printing apparatus is also of a non-impact type, including a magnetic printing apparatus, an ion-flow printing apparatus, and the like, in addition to the typical electrophotographic printing apparatus, has the same basic image formation processes including latent image erasing, latent image formation, development, transfer, fixing, and cleaning, and is thus low-noise, and high in print quality and printing speed. That is, since the printing apparatus has no print wire as seen in the impact dot matrix printing apparatus, it has a reduced number of moving parts, and does not generate a high noise such as an impact noise by the print wire and the like.

In the second printing apparatus, the transfer process is a type not utilizing a pressure such as an electrostatic transfer type. In the electrostatic transfer, for example, by applying a charge of the reverse polarity to the charge of the toner from the transfer roller to the recording paper, the toner on the latent image carrier is adhered by the electrostatic force to the surface of the recording paper, thereby achieving transfer. After that, copying is carried out by the two pressure rollers. Since, in this case, there is a relation of $t/4 \leqq d \leqq t+a$ among the total thickness t of the recording paper, the clearance d between the two pressure rollers, and the height a of the toner on the recording paper, the pressure at the part where the toner exists becomes greater than others, and the pressure is transmitted in the thickness direction of the recording paper through the toner, thereby achieving copying efficiently. Also in the second printing apparatus, the material of the two pressure rollers is harder at least than that of the toner and the recording paper, thereby transmitting the pressure efficiently.

A third printing apparatus of the present invention comprises a latent image eraser for erasing a latent image on a latent image carrier, a latent image former for forming a latent image on the latent image carrier, a developer for developing the latent image on the latent image carrier to an image by an aggregate of toners, a first transfer roller for transferring the image on the latent image carrier to itself, a second transfer roller for transferring the image on the first transfer roller to a recording paper comprising a stack of plural sheets sensitive to a pressure, a fixer for fixing the image on the recording paper, and a cleaner for removing the toner remaining on the latent image carrier after transfer, in a condition of $t/4 \leqq d \leqq t+a$ wherein d is a clearance between the first and second transfer rollers, t is a total thickness of the recording paper, and a is a height of the toner on the first transfer roller, and the recording paper is passed through the clearance between the first and second transfer rollers. Furthermore, as necessary, the toner has at least a two-layered structure consisting of a core part and a shell part, the core part has a greater elastic modulus than the shell part, and the first and second transfer rollers are made of a material having a Vickers hardness of 50 or more. The core part of the toner is made of a magnetic material, and the shell part is made of a resin. The height a of the toner is 30 μm or more. A sprocket with projections disposed at predetermined intervals in the circumferential direction is provided at both ends of one of the first and second transfer rollers. The length of the other transfer roller is shorter than the distance between the sprockets at both ends of the one transfer roller. The outer diameter of both ends of the other transfer roller is smaller than that of the central portion. The recording paper is a stack of plural sheets of pressure-sensitive paper which develops a color by a reaction of the color developer with the dye in the microcapsules, and the toner has a greater compressive strength than the microcapsules. The developer is a single-component dry developer. The pressure between the first and second transfer rollers is 5 kgf/cm or more in load per unit roller length.

The third printing apparatus is also of a non-impact type, including a magnetic printing apparatus, an ion-flow printing apparatus, and the like, in addition to the typical electrophotographic printing apparatus, has the same basic image formation processes including latent image erasing, latent image formation, development, transfer, fixing, and cleaning, and is thus low-noise, and high in print quality and printing speed. That is, since the printing apparatus has no print wire as seen in the impact dot matrix printing apparatus, it has a reduced number of moving parts, and does not generate a high noise such as an impact noise by the print wire and the like.

In the third printing apparatus, the transfer process is of a type not utilizing a pressure such as an electrostatic transfer type. In the electrostatic transfer, for example, by applying a charge of the reverse polarity to the charge of the toner to the first transfer roller, the toner on the latent image carrier is adhered by the electrostatic force to the surface of the first transfer roller, thereby achieving transfer. After that, copying is carried out by a pressure between the two transfer rollers. Since, in this case, there is a relation of $t/4d \leqq t+a$ among the total thickness t of the recording paper, the clearance d between the first and second transfer rollers, and the height a of the toner on the recording paper, the pressure at the part where the toner exists becomes greater than others, and the pressure is transmitted in the thickness direction of the recording paper through the toner, thereby achieving copying efficiently. Also in the third printing apparatus, the material of the first and second transfer rollers is harder at least than that of the toner and the recording paper, thereby transmitting the pressure efficiently.

A fourth printing apparatus of the present invention comprises a latent image eraser for erasing a latent image on a latent image carrier, a latent image former for forming a latent image on the latent image carrier, a developer for developing the latent image on the latent image carrier to an image by an aggregate of toners, a transfer roller for pressurizing a recording paper between the roller and the latent image carrier so that the image on the latent image carrier is pressure transferred to the recording paper comprising a stack of plural sheets sensitive to a pressure, a fixer for fixing the image on the recording paper, and a cleaner for removing the toner remaining on the latent image carrier after pressure transfer, and the transfer roller is formed of a rubber material having a rubber hardness of 30 to 80. Furthermore, as necessary, a sprocket with projections disposed at predetermined intervals in the circumferential direction is provided at both ends of the transfer roller. The length of the latent image carrier is shorter than the distance between the sprockets at both ends of the transfer roller. The latent image carrier is drum-formed, and the outer diameter of both ends of latent image carrier is smaller than that of the central portion. The recording paper is a stack of plural sheets of pressure-sensitive paper which develops a color by a reaction of the color developer with the dye in the microcapsules, and the toner has a greater compressive strength than the microcapsules. The developer is a single-component dry developer. The pressure in the pressure transfer is 5 kgf/cm or more in load per unit roller length.

The fourth printing apparatus is also of a non-impact type, including a magnetic printing apparatus, an ion-flow printing apparatus, and the like, in addition to the typical electrophotographic printing apparatus, has the same basic image formation processes including latent image erasing, latent image formation, development, transfer, fixing, and cleaning, and is thus low-noise, and high in print quality and printing speed. That is, since the printing apparatus has no print wire as seen in the impact dot matrix printing apparatus, it has a reduced number of moving parts, and does not generate a high noise such as an impact noise by the print wire and the like.

In the fourth printing apparatus, the transfer process is of a type utilizing a pressure such as a pressure transfer or an electrostatic pressure type, in which, by a pressure between the latent image carrier and the transfer roller, the toner undergoes plastic deformation to be adhered to the surface of the recording paper, thereby achieving transfer. In this case, since the transfer roller is made of the rubber material, the pressure at the part where the toner exists becomes greater than others, and the pressure is transmitted in the thickness direction of the recording paper through the toner, thereby achieving copying efficiently.

A fifth printing apparatus of the present invention comprises a latent image eraser for erasing a latent image on a latent image carrier, a latent image former for forming a latent image on the latent image carrier, a developer for developing the latent image on the latent image carrier to an image by an aggregate of toners, a transfer roller for transferring the image on the latent image carrier to copyable recording paper comprising a stack of plural sheets sensitive to a pressure, two pressure rollers for pressurizing the recording paper after transfer, a fixer for fixing the image on the recording paper, and a cleaner for removing the toner remaining on the latent image carrier after transfer, and one of the pressure rollers is formed of a rubber material having a rubber hardness of 30 to 80. Furthermore, as necessary, a sprocket with projections disposed at predetermined intervals in the circumferential direction is provided at both ends of one of the two pressure rollers. The length of the other pressure roller is shorter than the distance between the sprockets at both ends of the one pressure roller. The outer diameter of both ends of the other pressure roller is smaller than that of the central portion. The recording paper is a stack of plural sheets of pressure-sensitive paper which develops a color by a reaction of the color developer with the dye in the microcapsules, and the toner has a greater compressive strength than the microcapsules. The developer is a single-component dry developer. The pressure between the two pressure rollers is 5 kgf/cm or more in load per unit roller length.

The fifth printing apparatus is also of a non-impact type, including a magnetic printing apparatus, an ion-flow printing apparatus, and the like, in addition to the typical electrophotographic printing apparatus, has the same basic image formation processes including latent image erasing, latent image formation, development, transfer, fixing, and cleaning, and is thus low-noise, and high in print quality and printing speed. That is, since the printing apparatus has no print wire as seen in the impact dot matrix printing apparatus, it has a reduced number of moving parts, and does not generate a high noise such as an impact noise by the print wire and the like.

In the fifth printing apparatus, the transfer process is of a type not utilizing a pressure such as an electrostatic transfer type. In the electrostatic transfer, for example, by applying a charge of the reverse polarity to the charge of the toner from the transfer roller to the recording paper, the toner on the latent image carrier is adhered by the electrostatic force to the surface of the recording paper, thereby achieving transfer. After that, copying is carried out by the two pressure rollers. In this case, since one of the pressure rollers is made of the rubber material, the pressure at the part where the toner exists becomes greater than others, and the pressure is transmitted in the thickness direction of the recording paper through the toner, thereby achieving copying efficiently.

A sixth printing apparatus of the present invention comprises a latent image eraser for erasing a latent image on a latent image carrier, a latent image former for forming a latent image on the latent image carrier, a developer for developing the latent image on the latent image carrier to an image by an aggregate of toners, a first transfer roller for transferring the image on the latent image carrier to itself, a second transfer roller for pressurizing a recording paper between the first and second transfer rollers to pressure transfer the image on the first transfer roller to the recording paper comprising a stack of plural sheets of paper sensitive to a pressure, a fixer for fixing the image on the recording paper, and a cleaner for removing the toner remaining on the latent image carrier after transfer, and one of the first and second transfer rollers is formed of a rubber material having a rubber hardness of 30 to 80. Furthermore, as necessary, a sprocket with projections disposed at predetermined intervals in the circumferential direction is provided at both ends of one of the first and second transfer rollers. The length of the other transfer roller is shorter than the distance between the sprockets at both ends of the one transfer roller. The outer diameter of both ends of the other transfer roller is smaller than that of the central portion. The recording paper is a stack of plural sheets of pressure-sensitive paper which develops a color by a reaction of the color developer with the dye in the microcapsules, and the toner has a greater compressive strength than the microcapsules. The developer is a single-component dry developer. The pressure between the first and second transfer rollers is 5 kgf/cm or more in load per unit roller length.

The sixth printing apparatus is also of a non-impact type, including a magnetic printing apparatus, an ion-flow printing apparatus, and the like, in addition to the typical electrophotographic printing apparatus, has the same basic image formation processes including latent image erasing, latent image formation, development, transfer, fixing, and cleaning, and is thus low-noise, and high in print quality and printing speed. That is, since the printing apparatus has no print wire as seen in the impact dot matrix printing apparatus, it has a reduced number of moving parts, and does not generate a high noise such as an impact noise by the print wire and the like.

In the sixth printing apparatus, the transfer process is of a type not utilizing a pressure such as an electrostatic transfer type. In the electrostatic transfer, for example, by applying a charge of the reverse polarity to the charge of the toner to the first transfer roller, the toner on the latent image carrier is adhered by the electrostatic force to the surface of the first transfer roller, thereby achieving transfer. After that, transfer and copying to the recording paper are carried out by the two transfer rollers. In this case, since at least one of the first and second transfer rollers is made of the rubber material, the pressure at the part where the toner exists becomes greater than others, and the pressure is transmitted in the thickness direction of the recording paper through the toner, thereby achieving copying efficiently.

A seventh printing apparatus of the present invention comprises a latent image eraser for erasing a latent image on a latent image carrier, a latent image former for forming a latent image on the latent image carrier, a developer for developing the latent image on the latent image carrier to an image by an aggregate of toners, a transfer roller for pressuring a recording paper between the transfer roller and the latent image carrier to pressure transfer the image on the latent image carrier to the recording paper comprising a stack of plural sheets of paper sensitive to a pressure, a fixer for fixing the image on the recording paper, and a cleaner for removing the toner remaining on the latent image carrier after transfer, the transfer roller comprises a rigid roller and an elastic layer, and rigid particles of 5 to 70 μm in average particle diameter are dispersed in the toner. Furthermore, as necessary, a sprocket with projections disposed at predetermined intervals in the circumferential direction is provided at both ends of the transfer roller. The length of the latent image carrier is shorter than the distance between the sprockets at both ends of the transfer roller. The latent image carrier is drum-formed, and the outer diameter of both ends is smaller than that of the central portion. The rigid particles are magnetic particles. The thickness of the elastic layer is smaller than the average particle diameter of the rigid particles. The rigid roller has a Young's modulus of 100 GPa or more. The recording paper is a stack of plural sheets of pressure-sensitive paper which develops a color by a reaction of the color developer with the dye in the microcapsules, and the toner has a greater compressive strength than the microcapsules. The transfer pressure in the pressure transfer is 5 kgf/cm or more in load per unit roller length.

The seventh printing apparatus is also of a non-impact type, including a magnetic printing apparatus, an ion-flow printing apparatus, and the like, in addition to the typical electrophotographic printing apparatus, has the same basic image formation processes including latent image erasing, latent image formation, development, transfer, fixing, and cleaning, and is thus low-noise, and high in print quality and printing speed. That is, since the printing apparatus has no print wire as seen in the impact dot matrix printing apparatus, it has a reduced number of moving parts, and does not generate a high noise such as an impact noise by the print wire and the like.

In the seventh printing apparatus, the transfer process is of a type utilizing a pressure such as a pressure transfer type and an electrostatic pressure type, in which, by a pressure between the latent image carrier and the transfer roller, the toner on the latent image carrier undergoes plastic deformation to be adhered to the surface of the recording paper, thereby achieving transfer. In this case, since the transfer roller comprises the rigid roller and the elastic layer, and the rigid particles of 5 to 70 μm in average particle diameter are dispersed in the toner, the pressure at the part where the toner exists becomes greater than others, and the pressure is transmitted in the thickness direction of the recording paper through the toner, thereby achieving copying efficiently.

An eighth printing apparatus of the present invention comprises a latent image eraser for erasing a latent image on a latent image carrier, a latent image former for forming a latent image on the latent image carrier, a developer for developing the latent image on the latent image carrier to an image by an aggregate of toners, a transfer roller for transferring the image on the latent image carrier to copyable recording paper comprising a stack of plural sheets sensitive to a pressure, two pressure rollers for pressurizing the recording paper after transfer, a fixer for fixing the image on the recording paper, and a cleaner for removing the toner remaining on the latent image carrier after transfer, one of the pressure rollers comprises a rigid roller and an elastic layer, and rigid particles of 5 to 70 μm in average particle diameter are dispersed in the toner. Furthermore, as necessary, a sprocket with projections disposed at predetermined intervals in the circumferential direction is provided at both ends of one of the two pressure rollers. The length of the other pressure roller is shorter than the distance between the sprockets at both ends of the one pressure roller. The outer diameter of the other pressure roller at both ends is smaller than that of the central portion. The rigid particles are magnetic particles. The thickness of the elastic layer is smaller than the average particle diameter of the rigid particles. The rigid roller has a Young's modulus of 100 GPa or more. The recording paper is a stack of plural sheets of pressure-sensitive paper which develops a color by a reaction of the color developer with the dye in the microcapsules, and the toner has a greater compressive strength than the microcapsules. The developer is a single-component dry developer. The pressure between the two pressure rollers is 5 kgf/cm or more in load per unit roller length.

The eighth printing apparatus is also of a non-impact type, including a magnetic printing apparatus, ah ion-flow printing apparatus, and the like, in addition to the typical electrophotographic printing apparatus, has the same basic image formation processes including latent image erasing, latent image formation, development, transfer, fixing, and cleaning, and is thus low-noise, and high in print quality and printing speed. That is, since the printing apparatus has no print wire as seen in the impact dot matrix printing apparatus, it has a reduced number of moving parts, and does not generate a high noise such as an impact noise by the print wire and the like.

In the eighth printing apparatus, the transfer process is of a type not utilizing a pressure such as an electrostatic transfer type. In the electrostatic transfer, for example, by applying a charge of the reverse polarity to the charge of the toner from the transfer roller to the recording paper, the toner on the latent image carrier is adhered by the electrostatic force to the surface of the recording paper, thereby achieving transfer. After that, copying is carried out by the two pressure rollers. In this case, since one of the pressure rollers comprises the rigid roller and the elastic layer, and the rigid particles of 5 to 70 μm in average particle diameter are dispersed in the toner, the pressure at the part where the toner exists becomes greater than others, and the pressure is transmitted in the thickness direction of the recording paper through the toner, thereby achieving copying efficiently.

A ninth printing apparatus of the present invention comprises a latent image eraser for erasing a latent image on a latent image carrier, a latent image former for forming a latent image on the latent image carrier, a developer for developing the latent image on the latent image carrier to an image by an aggregate of toners, a first transfer roller for transferring the image on the latent image carrier to itself, a second transfer roller for pressurizing a recording paper between the first and second transfer rollers to pressure transfer the image on the first transfer roller to the recording paper comprising a stack of plural sheets of paper sensitive to a pressure, a fixer for fixing the image on the recording paper, and a cleaner for removing the toner remaining on the latent image carrier after transfer, one of the first and second transfer rollers comprises a rigid roller and an elastic layer, and rigid particles of 5 to 70 μm in average particle diameter are dispersed in the toner. Furthermore, as necessary, a sprocket with projections disposed at predetermined intervals in the circumferential direction is provided at both ends of one of the two pressure rollers. The length of the other pressure roller is shorter than the distance between the sprockets at both ends of the one pressure roller. The outer diameter of the other pressure roller at both ends is smaller than that of the central portion. The rigid particles are magnetic particles. The thickness of the elastic layer is smaller than the average particle diameter of the rigid particles. The rigid roller has a Young's modulus of 100 GPa or more. The recording paper is a stack of plural sheets of pressure-sensitive paper which develops a color by a reaction of the color developer with the dye in the microcapsules, and the toner has a greater compressive strength than the microcapsules. The developer is a single-component dry developer. The pressure between the first and second transfer rollers is 5 kgf/cm or more in load per unit roller length.

The ninth printing apparatus is also of a non-impact type, including a magnetic printing apparatus, an ion-flow printing apparatus, and the like, in addition to the typical electrophotographic printing apparatus, has the same basic image formation processes including latent image erasing, latent image formation, development, transfer, fixing, and cleaning, and is thus low-noise, and high in print quality and printing speed. That is, since the printing apparatus has no print wire as seen in the impact dot matrix printing apparatus, it has a reduced number of moving parts, and does not generate a high noise such as an impact noise by the print wire and the like.

In the ninth printing apparatus, the transfer process is of a type not utilizing a pressure such as an electrostatic transfer type. In the electrostatic transfer, for example, by applying a charge of the reverse polarity to the charge of the toner to the first transfer roller to the recording paper, the toner on the latent image carrier is adhered by the electrostatic force to the surface of the first transfer roller, thereby achieving transfer. After that, transfer and copying to the recording paper is achieved by the pressure between the two transfer rollers. In this case, since the first or second transfer roller comprises the rigid roller and the elastic layer, and the rigid particles of 5 to 70 μm in average particle diameter are dispersed in the toner, the pressure at the part where the toner exists becomes greater than others, and the pressure is transmitted in the thickness direction of the recording paper through the toner, thereby achieving copying efficiently.

BEST MODE FOR CARRYING OUT THE INVENTION

Embodiments of the present invention will now be described with reference to the drawings. Although the printing apparatus may be either of a magnetic type or an ion-flow type, a first embodiment described a magnetic type. An electrophotographic type will follow.

Figure 1:
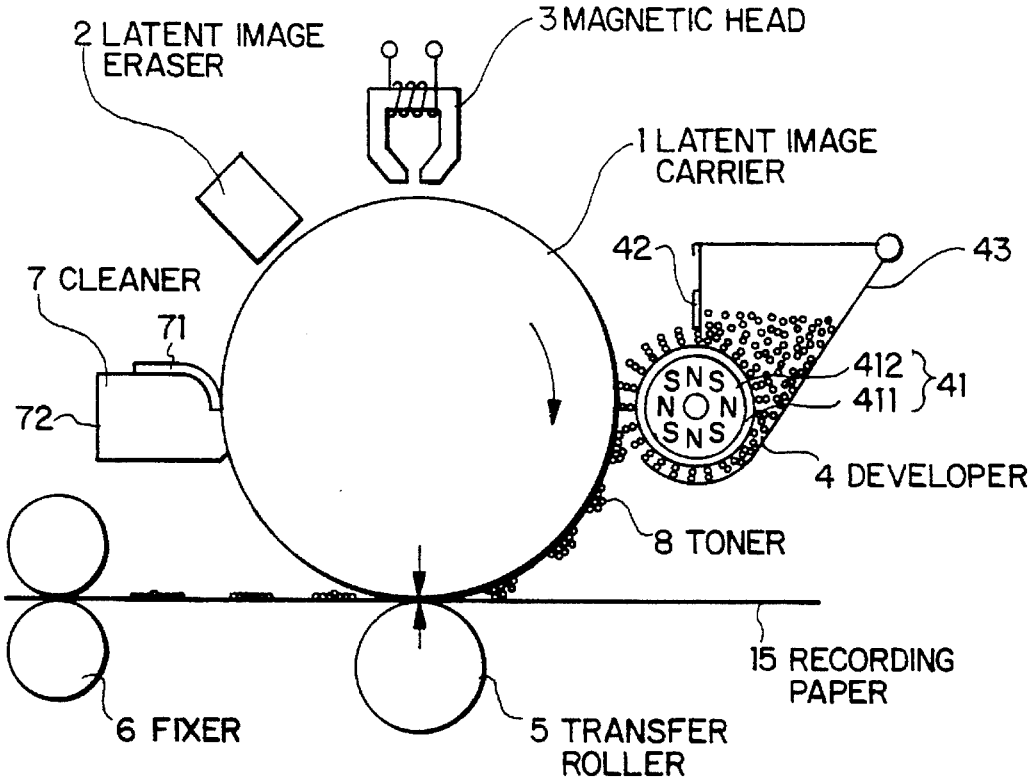
FIG. 1 is a schematic view showing the construction of an embodiment of the printing apparatus according to the present invention.
Figure 2:
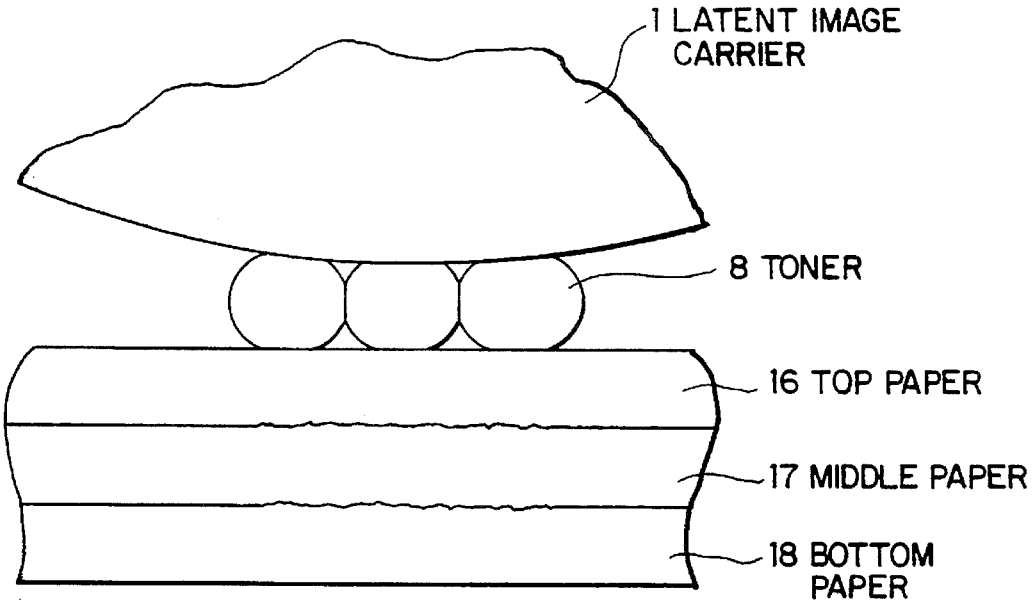
FIG. 2 is a schematic view showing the principle of copying.
Figure 3:
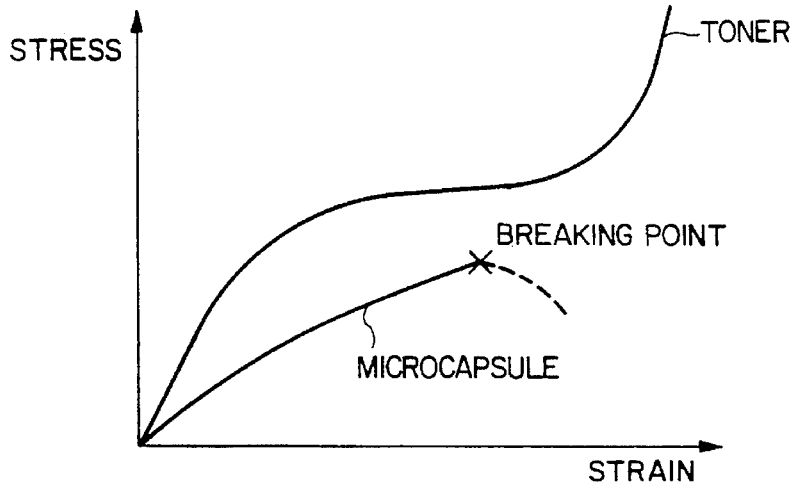
FIG. 3 is a graph showing the relation between compressive strengths of the toner and microcapsules.

FIG. 1 shows a brief construction of a magnetic printing apparatus of the present embodiment. A demagnetizer as a latent image eraser 2, a magnetic head 3 forming a latent image former, a developer 4, a transfer roller 5, a fixer or fuser 6, and a cleaner 7 are disposed in this order around a drum-formed latent image carrier 1. A recording layer and a protective layer for protecting the recording layer are formed on the surface of the latent image carrier 1. A toner 8 is of a dry type. This basic construction is disclosed in Japanese Patent Publications 50-40622, 55- 17382, 57-46795 and others. Printing process of the magnetic printing apparatus comprises latent image erasing (demagnetization), magnetic latent image formation, development, transfer, fixing, and cleaning. In the magnetic latent image formation, by a magnetization, the magnetic head 3 forms a magnetic latent image on the latent image carrier 1, the developer 4 causes the toner 8 to selectively adhere by a magnetic attraction force to achieve developing, the toner is transferred by the transfer roller 5 to a recording paper 15, and the toner 8 is melted by the fixer 6 to fix it. The printing apparatus of such a printing process features that it does not generate an impact noise due to a print wire as seen in an impact dot matrix printer and, since mechanical moving parts are reduced, is low noise. An electrophotographic or ion-flow printing apparatus which utilizes a static electricity is expected to have nearly the same low noise characteristics. With such a printing apparatus, a stack of two or more sheets of copyable recording paper 15 is fed, transported, and discharged, development is carried out by a single-component dry developing method using the toner 8 of 30 to 150 μm in average particle diameter, and pressure transfer is made between the latent image carrier 1 and the transfer roller 5 at a load per unit roller length of 5 kgf/cm or more. The recording paper 15 can be various types as exemplified in FIG. 19 or FIG. 20. For the pressure transfer system, the toner 8, while being plastically deformed by a pressure between the latent image carrier 1 and the transfer roller 5, is adhered to the surface of the recording paper 15, thereby achieving transfer. By the pressure at this moment, the toner 8 is plastically deformed as shown in FIG. 2, and the pressure is transmitted to the recording paper 15 through the toner 8, thereby achieving copying. Therefore, the pressure is required to be higher than a certain level in order to achieve copying, and a load per unit roller length of 5 kgf/cm or more is required to provide appropriate copying. Furthermore, the pressure is preferably to be in uniform distribution as possible.

The toner 8 transferred onto the recording paper 15, even being plastic-deformed by the pressure but not penetrating deep into the fibers of the recording paper 15, is heated by the fixer 6 to melt, and penetrates into the fibers of the recording paper 15, where it is fixed. The toner 8 does not peel even when the recording paper 15 is folded or a sticking tape is stuck and then peeled. The thermal fixer can be of a heat roll type, a flash lamp type, and the like. However, since the thermal characteristics are determined by the resin component of the toner 8, the amount of magnetic particle, and the like, and depend on the paper feed speed of fixing, it is necessary to set the condition such as the temperature and the radiation amount of IR light every time. When the transfer efficiency in the above process is not 100%, part of the toners 8 remains on the latent image carrier 1 after transfer. This is removed by the cleaner 7, which basically comprises an elastic blade 71 and a container 72 for the remained toner. Since the amount of remained toner increases when the transfer efficiency is low, a permanent magnet may be used to magnetically attract the remained toner, preventing scattering. When making a new printing cycle, it is necessary to erase old magnetic latent image by the demagnetizer 2 before a magnetic latent image is formed. The demagnetizer 2 includes a permanent magnet type and a electromagnet type. The permanent magnet type uniformly magnetizes the latent image carrier 1 in the circumferential direction to prevent the magnetic flux from leaking locally, thus requires no energy such as electric power, and is inexpensive. However, when it is not necessary to erase magnetic latent image, the latent image eraser 2 must be moved away from the latent image carrier 1 to weaken the erasing magnetic field. On the other hand, the electromagnetic type comprises a yoke and a coil, and requires an electric current to be passed. However, when it is not necessary to erase latent image, the electric current can be cut off to make the erasing magnetic field zero, and therefore the control is relatively easy.

Figure 19:
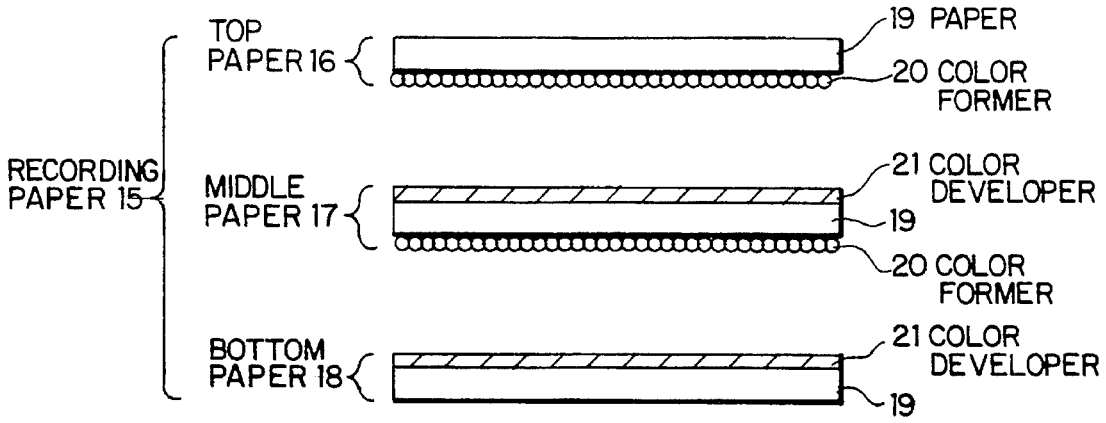
FIG. 19 is a schematic view showing the construction of recording paper using carbonless paper.

When carbonless paper is used as the recording paper 15, the compressive strength of the toner 8 is set higher than that of microcapsules constituting a color former 20 of the recording paper 15. FIG. B shows the relation between the stress and strain. From FIG. B, when a stack of three sheets of copyable carbonless paper shown in FIG. 19 is fed as the recording paper 15, the toner 8 is transferred to a top paper 16 and, since it is passed between the latent image carrier 1 and the transfer roller 5, a pressure is generated, the toner 8 is plastically deformed and presses the top paper 16, a middle paper 17, and a bottom paper 18. The pressure at this moment destroys the microcapsules of the color former 20 coated on the back side of the middle paper 17 and the bottom paper 18, and a dye contained therein comes out to develop a color, thereby achieving copying.

Figure 4:
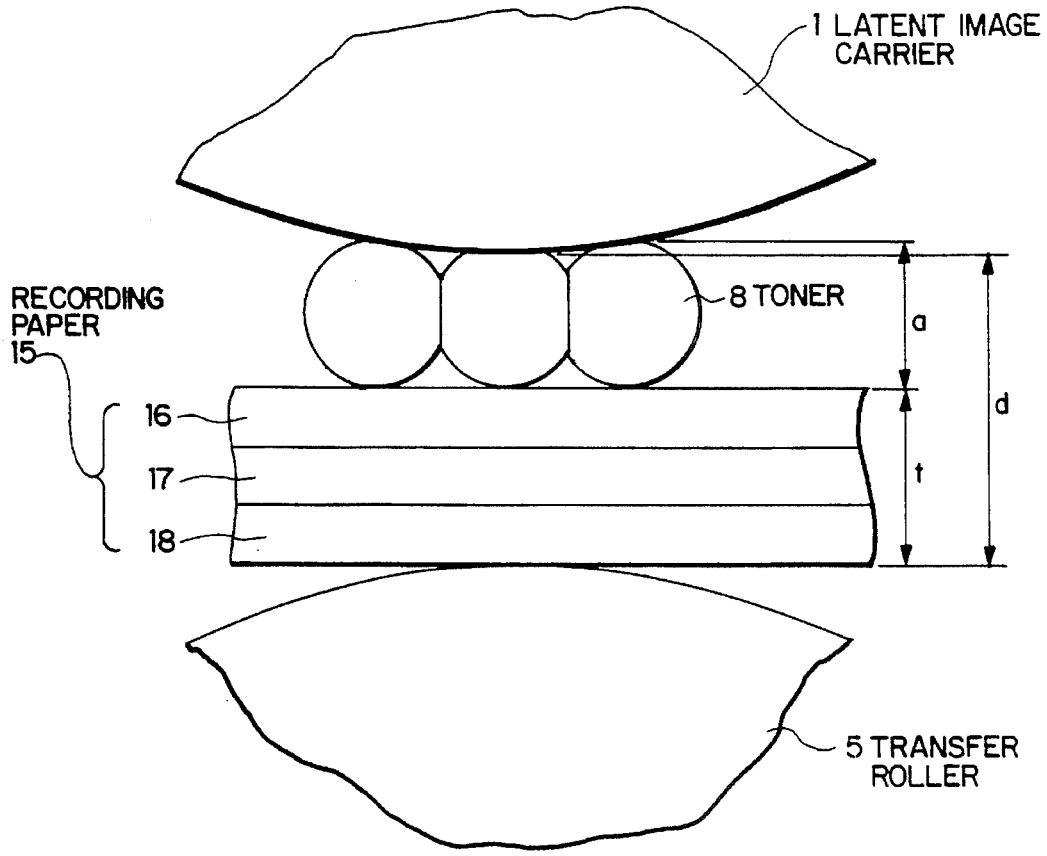
FIG. 4 is a schematic view showing clearance between the latent image carrier and the transfer roller.
Figure 5:
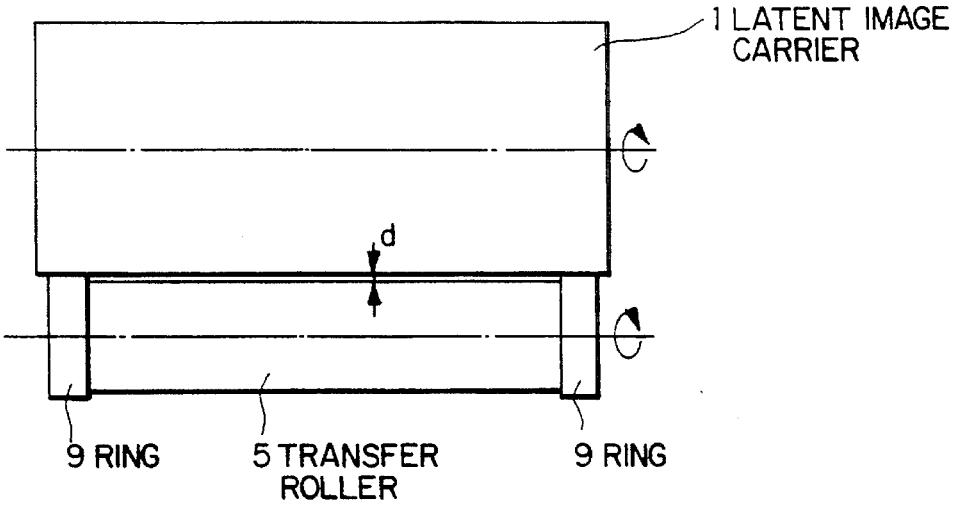
FIG. 5 is a schematic view showing the transfer roller with rings, FIG. 6 schematic view showing the height a of the toner.
Figure 6:
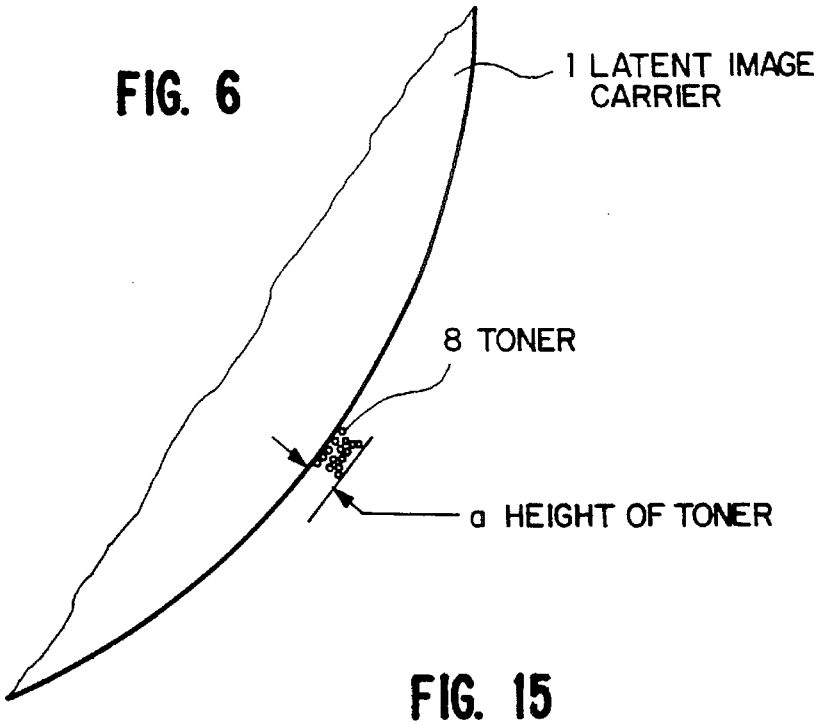

In the printing apparatus of the present embodiment shown in FIG. 1, a clearance d between the latent image carrier 1 and the transfer roller 5 is set in the range of $t/4 \leqq d \leqq t+a$. Wherein, as shown in FIG. 4, t is a total thickness of the recording paper 15, a is a height of the toner 8 on the latent image carrier 1. Furthermore, to maintain the clearance d, as shown in FIG. 5, rotatable rings 9 are provided, independent of the transfer roller 5, at both ends of the transfer roller 5, and these rings 9 are contacted with the latent image carrier 1. As shown in FIG. 6, the height a of the toner 8 is increased so as a $\geqq 30$ μm, preferably a $\leqq 40$ μm, more preferably a $\leqq 50$ μm by increasing the force of the latent image on the latent image carrier 1 to attract the toner 8, or increasing the particle size of the toner 8. This increases the pressure at the portion where the toner 8 exists over others compared to a prior art printing apparatus, and the pressure is transmitted in the thickness direction of the recording paper 15 through the toner 8, thereby achieving copying. The greater the height a, the more the allowance of the clearance d and the clearer the copying.

Then, the magnetic printing apparatus shown in FIG. 1 will be described in detail.

The material of the latent image carrier 1 is harder than the toner 8 and recording paper 15, with a Vickers hardness of 50 or more. In an example, a drum made of a metal such as aluminum is formed with a hard underlayer such as Ni or Ni—P to a thickness of about 5 to 30 μm, on which a magnetic recording layer of Co—Ni, Co—P, Ni—Co—P, or Ni—Co— Zn—P is formed to a thickness of 1 to 15 μm, and further a protective layer of Ni or Ni—P is formed on top to a thickness of 0.3 to 5 μm. Since, if the plating of the underlayer has a defect such as a pinhole, the magnetic recording layer will also have a defect, a fine and uniform film formation is required. The surface accuracy of the underlayer and the protective layer is maintained by tape polishing or the like, thereby maintaining a good accuracy of the clearance with the magnetic head 3 forming a magnetic latent image. Sputtering or deposition can also be used in addition to plating. The magnetic recording layer preferably has magnetic characteristics of about 200 to 1000 Oe in coercive force, with a residual magnetization as high as possible. The above is the construction of a magnetic recording medium for a horizontal recording type and, for a vertical recording type, there is a soft magnetic layer with a high permeability under the recording layer, but the present invention is not limited to any one of them.

The latent image former comprises the magnetic head 3 and its scanning mechanism, or a series of closely packed magnetic heads 3. The series of closely packed magnetic heads require no scanning, but otherwise it is necessary to scan the magnetic head in an axial direction of the latent image carrier 1. The scanning method includes a serial scanning and a helical scanning, and the helical scanning is higher in recording speed, but the rotation speed of the latent image carrier 1 must be changed specially only for the latent image formation process. An electric current is passed through the coil of the magnetic head 3 to generate a leakage flux from the magnetic pole, which magnetizes the magnetic recording medium to form a latent image. The output from the magnetic head 3 is required to be about 2 to 3 times the coercive force of the magnetic recording medium. The formed magnetic latent image is not lost unless it is erased by the latent image eraser 2, and development, transfer, fixing, and cleaning steps can be repeated to obtain a multi-copying function, which is a feature of the magnetic printing apparatus. Furthermore, since the magnetic latent image is less affected by humidity, it is superior in environmental safety to the electrostatic type. Magnetic recording includes a horizontal recording type and a vertical recording type, but the present invention is not limited to any one of them.

The developer 4 shown in FIG. 1 is called a magnetic brush developing method, which comprises a magnet roller 41 in which a cylindrical magnet 412 is concentrically disposed in a sleeve 411 made of a nonmagnetic metal such as aluminum or stainless steel, a doctor blade 42 for regulating the accumulated height of the toner 8, a toner container 43, and a rotation mechanism and its control unit (both not shown) of the sleeve 411 and the magnet 412. The cylindrical magnet 412 is formed of an isotropic ferrite magnet or the like, uniformly magnetized by 6 to 12 poles. The magnetic flux density on the surface of the sleeve is measured by a Hall device or the like while the cylindrical magnet 412 is rotated, characteristics close to a sinusoidal wave can be obtained. When the toner 8 is put into the toner container 43, the toner 8 is built up according to the magnetic field strength on the sleeve surface, and the toner 8 can be fed. The stacking is regulated by the doctor blade 42 to form a stack of the toner having a constant height from the sleeve surface, and the accumulated toner contacts the surface of the latent image carrier 1 to achieve development. Since this structure is relatively simple and inexpensive, it is often used in electrophotographic copiers and printers. The development is not limited only to the magnetic brush developing method if it is a single-component dry developing method, for example, a pressure developing method, a touch-down method, a magnetodynamic method, or the like can be used, and is not limited to the magnetic brush developing method. The magnet 412 is not limited to a uniformly magnetized type as shown, but may have a plurality of poles unequally magnetized.

The toner 8 basically comprises a binder and magnetic particles and, as necessary, a coloring agent, a charge control agent, conductivity control agent, a fluidizing agent, an IR absorber, a release agent, or a dispersant is added internally or externally. The binder includes polystyrene resin, polyethylene resin, polyester resin, styrene-acrylic copolymer resin, polyolefin resin, ethylene-vinylacetate copolymer resin, bisphenol A type epoxy resin, polyamide resin, and wax, which can be used alone or as mixtures. The magnetic particle is preferably a magnetic material including oxides such as $\gamma$-$Fe_2O_3$, Co-$\gamma$-$Fe_2O_3$, Ba ferrite, $Fe_3O_4$, $CrO_2$, and Co—$FeO_2$; nitrides such as $Fe_2N$; elements or alloys of iron, cobalt, and nickel; a compound. The magnetic particle is uniformly dispersed in a resin. The more the content of the magnetic particle, the better the magnetic characteristics, but since excessive amounts of the magnetic particle result in degradation of transferability and fixability, and a content of 10 to 70 wt % is preferable. The content is limited because, as the magnetic particle content increases, the specific gravity of the toner 8 becomes higher, effect of gravity becomes higher compared to the magnetic attractive force, and development cannot be carried out smoothly. Depending on the resolution of the printing apparatus, the average particle diameter of the toner 8 is preferably 30 to 150 μm.

Figure 7:
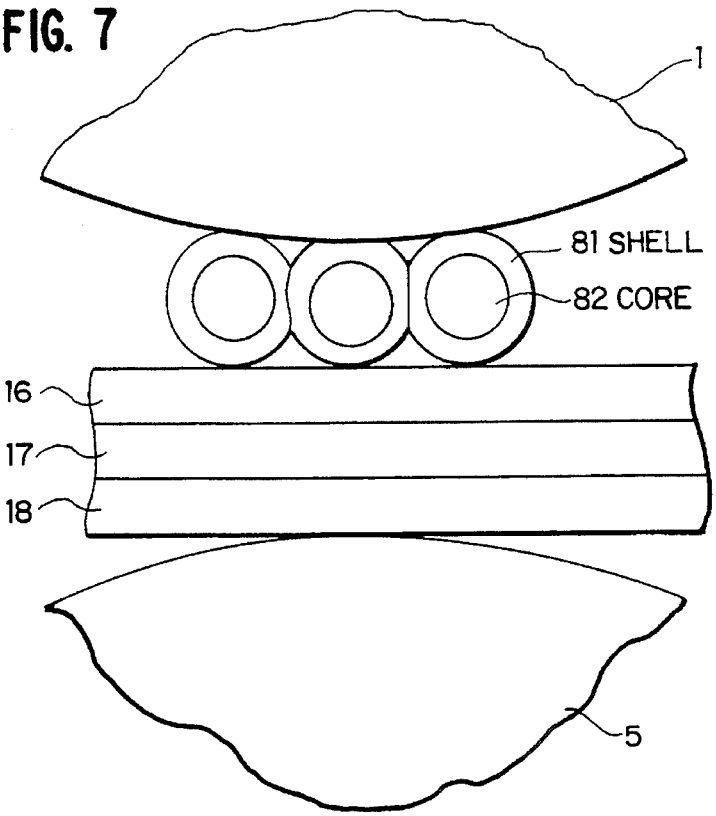
FIG. 7 is a schematic view showing an example of the toner of the present invention.
Figure 8:
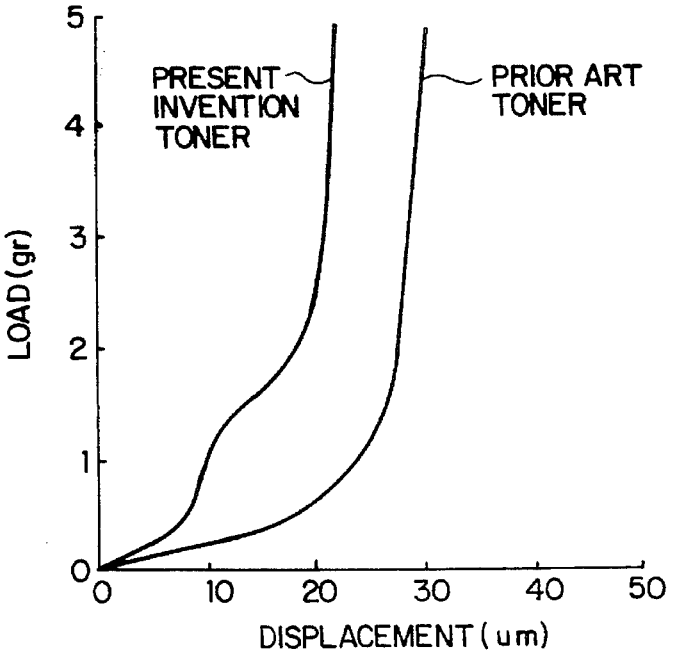
FIG. 8 is a graph showing compression test results of inventive and prior art toners.

A practical example of the toner 8 has a double-layered structure of a shell 81 and a core 82 as shown in FIG. 7, contains the binder and the magnetic particle as essential components and, as necessary, a coloring agent, a charge control agent, a conductivity control agent, a fluidizing agent, an IR absorber, a release agent, a dispersant, and the like are added internally or externally. It is preferable that the shell 81 does not contain a magnetic particle so as to be easily plastically deformable as possible, but is preferable to contain a magnetic particle in view of the magnetic characteristics.

As the binder of the shell 81, polyamide resin, low-molecular-weight polyethylene resin, low-molecular-weight polyolefin resin, ethylene-vinylacetate copolymer resin, higher fatty acid resin, polyester resin, and the like can be used alone or as mixtures thereof. As the binder of the core 82, homopolymer or copolymer resins of styrene and its substituents, copolymer resins of styrene and (meth)acrylic ester, multi-component copolymer resins of styrene, (meth)acrylic ester, and other vinyl monomers, multicomponent copolymer resins of styrene and other vinyl monomers, and those with part of the above resins cross-linked can be used. Furthermore, bisphenol A type epoxy resin, polymethylmethacrylate resin, polybutylmethacrylate resin, polyvinylacetate resin, polyurethane resin, silicone resin, polyvinylbutyral resin, polyvinylalcohol resin, polyacrylic acid resin, phenolic resin, aliphatic or alicyclic hydrocarbon resin, petroleum resin, and the like can also be used alone or as mixtures thereof. As the magnetic particle, oxides such $\gamma$-$Fe_2O_3$, Co-$\gamma$-$Fe_2O_3$, Ba ferrite, $Fe_3O_4$, $CrO_2$, and Co—$FeO_2$; nitrides such as $Fe_2N$, elements or alloys of iron, cobalt, and nickel; a compound are suitable.

The core 82 is produced by a kneading crushing method, a polymerization method, or the like. The kneading crushing method will be described as an example. The binder, the magnetic particle, and the like as raw materials are mixed, which are thoroughly premixed by a super-mixer, melted and kneaded by a biaxial extruder and, after cooling and solidifying, finely pulverized by a jet pulverizer. As necessary, the product is classified by a wind classifier to obtain the toner 8 of the desired particle size distribution. The magnetic characteristics are improved as the magnetic particle content increases, but a content of 30 to 70% by weight is preferable. Depending on the resolution of the printing apparatus, the average particle diameter of the toner 8 is preferably 30 to 150 μm.

Then, a method for forming the shell 81 on the outer periphery of the core 82 will be described. Resin fine powder of the shell 81 is mixed with the core 82, and the formed by a mechano-chemical reaction. Specifically, high-speed fluidizing agitators such as Mechano-Fusion System (Hosokawa Micron), Nara Hybridization (Nara Kikai), Mechano-Mill (Okada Seiki), and the like can be used. Other machines that can add mechanical and thermal energies can be basically used, and are not limited to the above apparatus. At this moment, hydrophobic silica (average particle diameter: about 0.03 μm) or the like may be added. The ratio of the shell 81 and the core 82 is determined in consideration of the transferability and copyability, and also depends upon the resolution of the printing apparatus, the thickness and the number of recording paper. The thus obtained toner is compression tested by a micro-compression tester (Shimadzu MCTM-500), and test results of prior art toner and the inventive toner are compared in Table 8. In the prior art toner, the load tends to increase monotonously, and then sharply increase when the particles are destroyed to some extent. On the other hand, in the toner of the present invention, the monotonous increasing period is short and, after once sharply increases, becomes moderate, and then sharply increases. This shows the effects of the double-layered structure of the toner of the present invention.

The toner 8 is not limited to those of the double-layered structure, but those of single-layered structure and others may also be used.

The image visualized by the developer 4 is transferred to the recording paper 15 by the transfer roller 5. In general, the transfer roller 5 includes an electrostatic transfer type, a pressure transfer type, and an electrostatic pressure type which combines the former two types. In the electrostatic transfer type, the recording paper 15 is given a charge reverse to the charge of the toner 8 by a charger to achieve transfer by an electrostatic force. In the pressure transfer type, the toner 8, while being plastically deformed, is transferred to the surface of the recording paper 15 by a pressure between the latent image carrier 1 and the transfer roller 5. By the pressure at this moment, the pressure is transferred to the recording paper 15 through the toner 8 to achieve copying. To transfer a uniform pressure, the transfer roller 5 is preferably made of a hard material having a Vickers hardness of 50 or more such as a metal which is hard to be deformed and does not cause a localized deformation compared to the toner 8 and the recording paper 15. Specifically, aluminum alloys, copper alloys, carbon steel, and stainless steel are suitable. The recording paper 15 and the toner 8 which are sensitive to a pressure are located between the latent image carrier 1 and the transfer roller 5, and the pressuring condition is shown in FIG. 7. The toner 8 is plastically deformed by the pressure, in which the shell 81 has a smaller elastic modulus and is deformed earlier, and the core 82 has a greater elastic modulus and is deformed later, and the deformation amount is relatively small, thereby efficiently transmit the pressure in the thickness direction of the recording paper.

The toner 8 transferred onto the recording paper 15, even being plastic-deformed by the pressure but not penetrating deep into the fibers of the recording paper 15, is heated by the fixer 6 to melt, and penetrates into the fibers of the recording paper 15, where it is fixed. The thermal fixer 6 can be of a heat roll type, a flash lamp type, and the like. However, since the thermal characteristics are determined by the resin component of the toner 8, the amount of magnetic particle, and the like, and depend also on the paper feed speed of fixing, it is necessary to set the condition such as the temperature and the radiation amount of IR light. When the transfer efficiency in the above process is not 100%, part of the toner 8 remains on the latent image carrier 1 after transfer. This is removed by the cleaner 7. When making a new printing cycle, old magnetic latent image is erased by the demagnetizer 2 before a magnetic latent image is formed.

Another embodiment of the toner 8 of the double-layered structure will be described. Since the core 82 used in the present invention is not required to be plastically deformed, the magnetic particle of a large average particle diameter, as is, is used. As the binder of the shell 81, polyamide resin, low-molecular-weight polyethylene resin, low-molecular-weight polyolefin resin, ethylene-vinylacetate copolymer resin, higher fatty acid resin, polyester resin, and the like can be used alone or as mixtures thereof. As the magnetic particle, oxides such $\gamma$-$Fe_2O_3$, Co-$\gamma$-$Fe_2O_3$, Ba ferrite, $Fe_3O_4$, $CrO_2$, and Co—$FeO_2$; nitrides such as $Fe_2N$; elements or alloys of iron, cobalt, and nickel; a compound are suitable. Resin fine particles of the shell 81 are mixed with the core 82, and then formed by a mechano-chemical reaction. Specifically, high-speed fluidizing agitators such as Mechano-Fusion System (Hosokawa Micron), Nara Hybridization (Nara Kikai), Mechano-Mill (Okada Seiki), and the like can be used. Other machines that can add mechanical and thermal energies can be basically used, and are not limited to the above apparatus. At this moment, hydrophobic silica (average particle diameter: about 0.03 μm) or the like may be added to improve the fluidity. The ratio of the shell 81 and the core 82 is determined in consideration of the transferability and copyability, and also depends upon the resolution of the printing apparatus, the thickness and the number of recording paper. In this case, since the ratio of the magnetic particle is high, the toner 8 has improved magnetic characteristics, has a strong magnetic absorption force during development, and is expected to provide stable developing characteristics. Furthermore, since the core 82 is formed only of the magnetic particle, the shell 81 can be formed without deformation.

Figure 9:
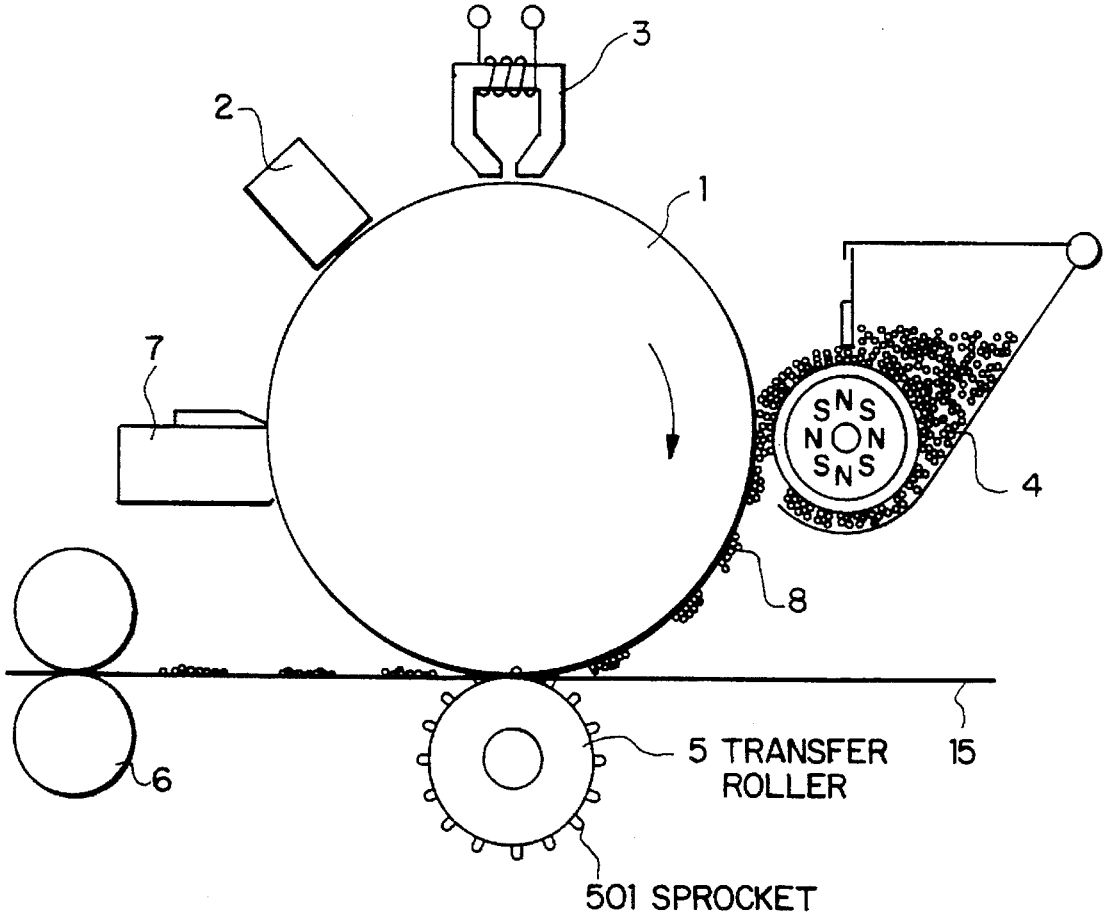
FIG. 9 is a schematic view showing another embodiment of the printing apparatus of the present invention.
Figure 10A:
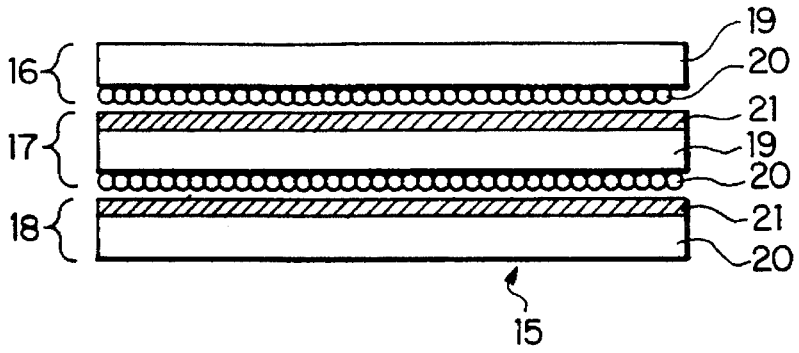
FIG. 10 is a schematic view showing condition of the recording paper.
Figure 10B:
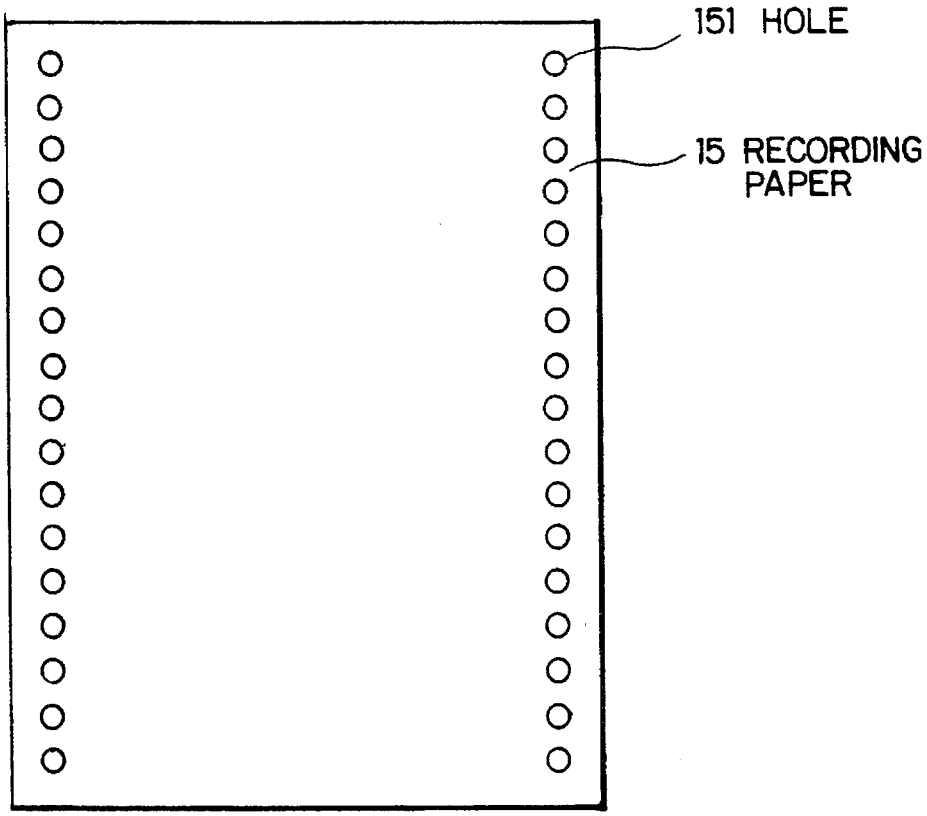
Figure 11A:
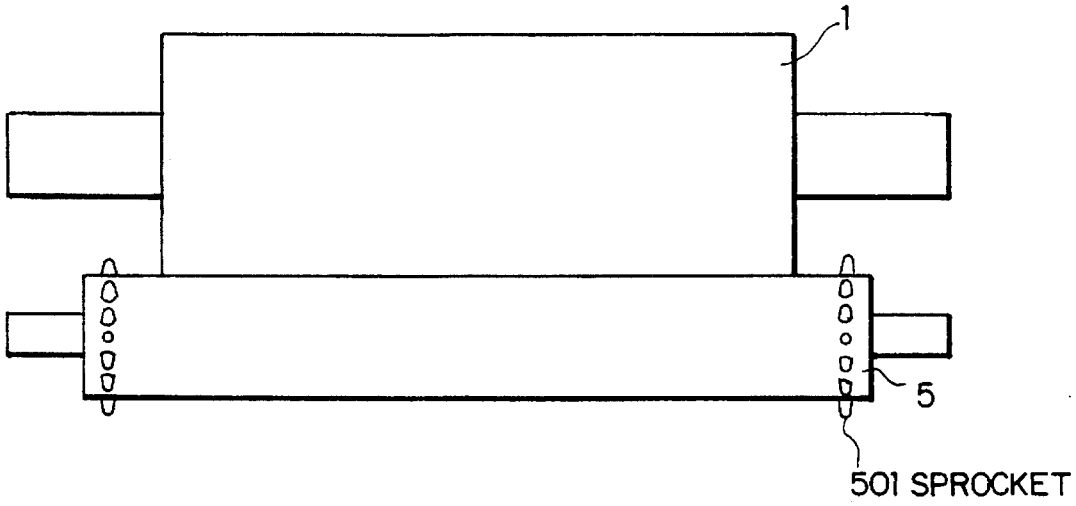
FIG. 11 is a schematic view showing the relation between the drum-formed latent image carrier and the transfer roller with sprocket.
Figure 11B:
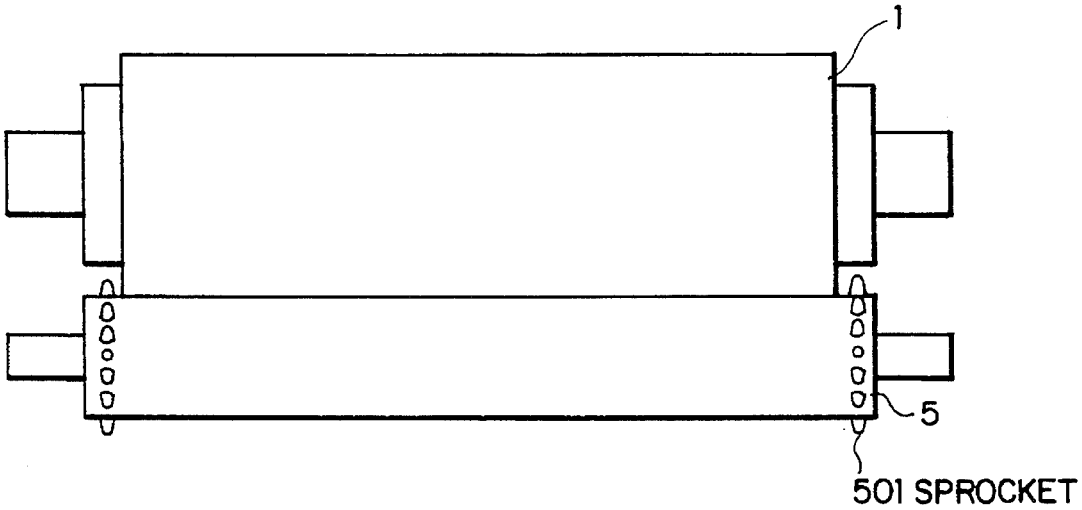

FIG. 9 shows an embodiment in which, in the magnetic printing apparatus shown in FIG. 1, a sprocket with projections 501 disposed at predetermined intervals is disposed at both ends of the transfer roller 5. That is, when copying on the pressure-sensitive paper, since a stack of plural sheets are fed as the recording paper 15 as shown in FIG. 10(*a*), the recording paper tends to cause deviation during transportation. FIG. 10(*b*) shows a condition of the recording paper 15. The recording paper 15 is provided with holes 151 disposed at predetermined intervals at both ends for transportation and, corresponding to this, the transfer roller 5 is provided with a sprocket with projections 501 disposed at equal intervals in the circumferential direction at both ends, and the sprocket 501 is inserted sequentially into the holes 151 of the recording paper 15 to transport the recording paper. FIG. 11(*a*) shows an embodiment using a combination of a drum-formed latent image carrier 1 and the transfer roller 5, in which the length of the latent image carrier 1 is shorter than the distance between the sprockets 501 so that the sprocket 501 provided at both ends of the transfer roller 5 do not contact the latent image carrier 1. Furthermore, FIG. 11(*b*) shows another embodiment using a combination of the latent image carrier 1 and the transfer roller 5, in which, for the same reason, the outer diameter of the latent image carrier 1 at both ends is smaller than that of the central portion. As described above, with the sprocket 501 provided at both ends of the transfer roller 5, when a stack of plural pressure-sensitive sheets is fed, it is fed to the transfer process without deviation between sheets, positively transferred, and stably fed to the subsequent fixing process. This copying mechanism is effective, because a tendency of deviation between the pressure-sensitive sheets increases as the number of sheets is increased. Furthermore, compared with a prior art paper feed mechanism provided with sprocket, no deviation occurs even when a slipping force is applied between the plural sheets due to a pressure during the pressure transfer.

Figure 12:
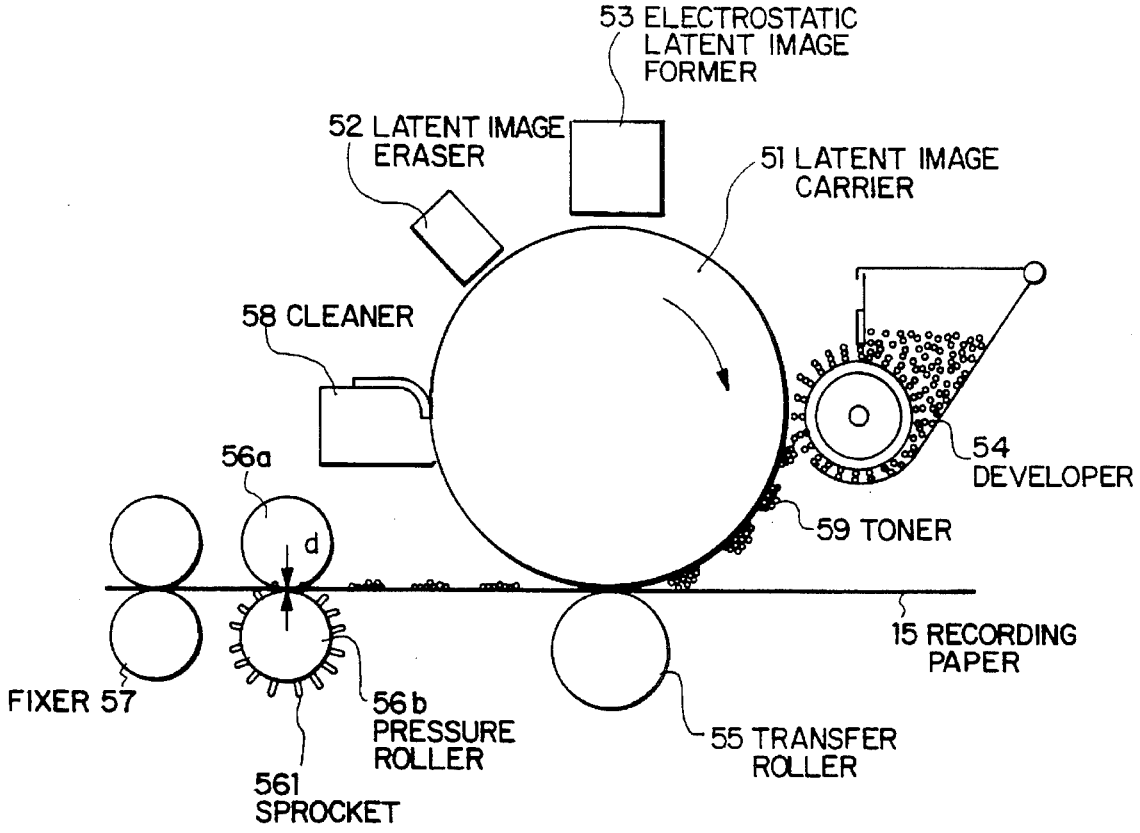
FIG. 12 is a schematic view showing further embodiment of the printing apparatus of the present invention.

Then, the electrophotographic printing apparatus will be described as another embodiment of the present invention. FIG. 12 is a schematic view showing the construction of the electrophotographic printing apparatus of the present embodiment. A latent image eraser 52, a latent image former 53, a developer 54, a transfer roller 55 for electrostatic transfer, two pressure rollers 56*a* and 56*b* for copying, a fixer 57, and a cleaner 58 are disposed in this order around a drum-formed latent image carrier 51. A clearance d between the two rollers 56*a* and 56*b* is set to $t/4 \leqq d \leqq t+a$ wherein t is a total thickness of the recording paper 15, and a is a height of the toner 59 on the recording paper 15. The force for the latent image on the electrostatic latent image carrier 51 to attract the toner 59 is increased, or the particle diameter of the toner 59 is increased so as to achieve a $\geqq 30$ μm. Furthermore, when carbonless paper is used, the compressive strengths of the toner 59 and the microcapsules constituting the color former 20 of the recording paper 15 are adjusted so that the former is greater than the latter. This relation is for the same reason as above. The latent image eraser 52 erases an electrostatic latent image by exposure or charging. The toner 59 can be any of the above-described double-layered structure type of the shell 81 and the core 82 and those of the single-layered type. Furthermore, the two pressure rollers 56*a* and 56*b* are made of a material harder than the toner 59 and the recording paper 15, and having a Vickers hardness of 50 or more. To prevent a deviation of the recording paper when making copying by applying a pressure by the two pressure rollers 56*a* and 56*b*, a sprocket with projections 561 disposed at predetermined intervals in the circumferential direction is provided at both ends of one of the pressure rollers, for example, the lower roller 56*b*. Also in this case, as shown in FIGS. 11(*a*) and 11(*b*), the length of the upper pressure roller 56*a* is made shorter than the distance between the sprockets 561, or the outer diameter of the roller 56*a* at both ends is made smaller than that of the central portion, to prevent the other roller 56*a* from contacting the sprocket 561.

In operation, first, an electrostatic latent image on the latent image carrier 51 is erased by the latent image eraser 52. Then, an electrostatic latent image is formed on the latent image carrier 51 by the electrostatic latent image former 53, the toner 59 is selectively adhered by an electrostatic attraction force to the surface of the latent image carrier 51 by the developer 54 to form an image. In this case, a magnetic brush developing type of developer 54 is used. The recording paper 15 is transported, inserted between the latent image carrier 51 and the transfer roller 55, and the toner 59 on the latent image carrier 51 is transferred by an electrostatic attraction force onto the recording paper 15. The recording paper 15 after transfer is inserted between the two pressure rollers 56*a* and 56*b*, and copying is achieved by transmitting a pressure applied at this moment to the recording paper 15 through the toner 59. Since the transferred toner 59 does not penetrate deep into the fibers of the recording paper 15, it is melted by thermal fixing to penetrate into the fibers. This fixes the toner 59 securely to the recording paper 15 by an anchoring effect. Almost of the toner 59 on the latent image carrier 51 is transferred to the recording paper 15, but part of it may remain. The cleaner 58 removes the residual toner to maintain the surface of the latent image carrier 51 clean, preventing spotting or the like in subsequent printing.

Figure 13:
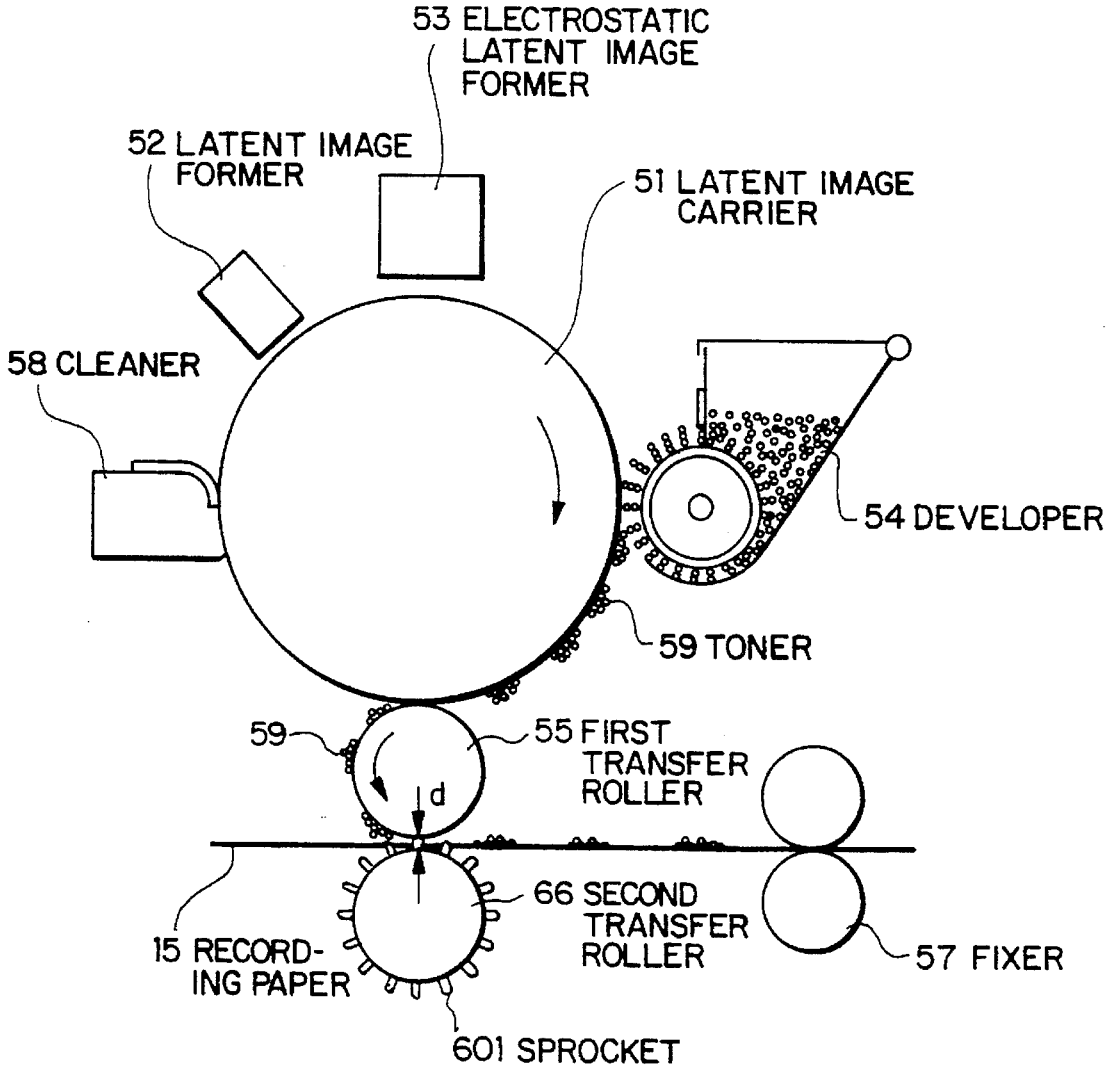
FIG. 13 is a schematic view showing further embodiment of the printing apparatus of the present invention.

Then, a further embodiment of the electrophotographic printing apparatus of the present invention will be described. FIG. 13 is a schematic view showing the construction of the electrophotographic printing apparatus of the present embodiment. The latent image eraser 52, the latent image former 53, the developer 54, a first transfer roller 55 for electrostatic transfer, the fixer 57, and the cleaner 58 are disposed in this order around the drum-formed latent image carrier 51. Furthermore, a second transfer roller 60 for pressure transfer is disposed with a clearance d to the first transfer roller 55. The clearance d is set to $t/4 \leqq d \leqq t+a$ wherein t is a total thickness of the recording paper 15, and a is a height of the toner 59 on the first transfer roll 55. The force for the latent image on the electrostatic latent image carrier 51 and the first transfer roller 55 to attract the toner 59 is increased, or the particle diameter of the toner 59 is increased so as to achieve a $\geqq 30$ μm. Furthermore, when carbonless paper is used, the compressive strengths of the toner 59 and the microcapsules constituting the color former 20 of the recording paper 15 are adjusted so that the former is greater than the latter. This relation is for the same reason as above. The toner 59 can be any of the above-described double-layered structure type of the shell 81 and the core 82 and those of the single-layered type. Furthermore, the first and second transfer rollers 55 and 60, as the above transfer roller 5, are made of a material harder than the toner 59 and the recording paper 15 having a Vickers hardness of 50 or more. To prevent a vertical deviation of the recording paper 15 when making transfer and copying by applying a pressure by the two transfer rollers 55 and 60, a sprocket with projections 601 disposed at predetermined intervals in the circumferential direction is provided at both ends of one of the transfer rollers, for example, the lower second transfer roller 60. Also in this case, as shown in FIGS. 11(*a*) and 11(*b*), the length of the first transfer roller 56*a* is made shorter than the distance between the sprockets 601, or the outer diameter of the roller at both ends is made smaller than that of the central portion, to prevent the other transfer roller 55 from contacting the sprocket 601.

In operation, first, an electrostatic latent image on the latent image carrier 51 is erased by the latent image eraser 52. Then, an electrostatic latent image is formed on the latent image carrier 51 by the electrostatic latent image former 53, the toner 59 is selectively adhered by an electrostatic attraction force to the surface of the latent image carrier 51 by the developer 54 to form an image. In this case, a magnetic brush developing type of developer 54 is used. The toner 59 on the latent image carrier 51 is once transferred by an electrostatic attraction force to the first transfer roller 55. The recording paper 15 is transported, inserted into the clearance between the first transfer roller 55 and the second transfer roller 60, and the toner 59 on the first transfer roller is transferred by a pressure onto the recording paper 15. Copying is achieved by transmitting a pressure applied at this moment to the recording paper 15 through the toner 59. Since the transferred toner 59 does not penetrate deep into the fibers of the recording paper 15, it is melted by thermal fixing to penetrate into the fibers. This fixes the toner 59 securely to the recording paper 15 by an anchoring effect. Almost of the toner 59 on the latent image carrier 51 is transferred to the recording paper 15, but part of it may remain. The cleaner 58 removes the residual toner to maintain the surface of the latent image carrier 51 clean, preventing spotting or the like in subsequent printing.

In the above-described printing apparatus, the two elements (the latent image carrier 1 and the transfer roller 5 in FIGS. 1 and 9, the two pressure rollers 56*a* and 56*b* in FIG. 12, and the first and second transfer rollers 55 and 60 in FIG. 13) for applying a pressure to the recording paper 15 for copying are made of a material having a Vickers hardness of 50 or more.

However, at least one of the two elements may have an elasticity. An embodiment for such a case will be described below.

Figure 14:
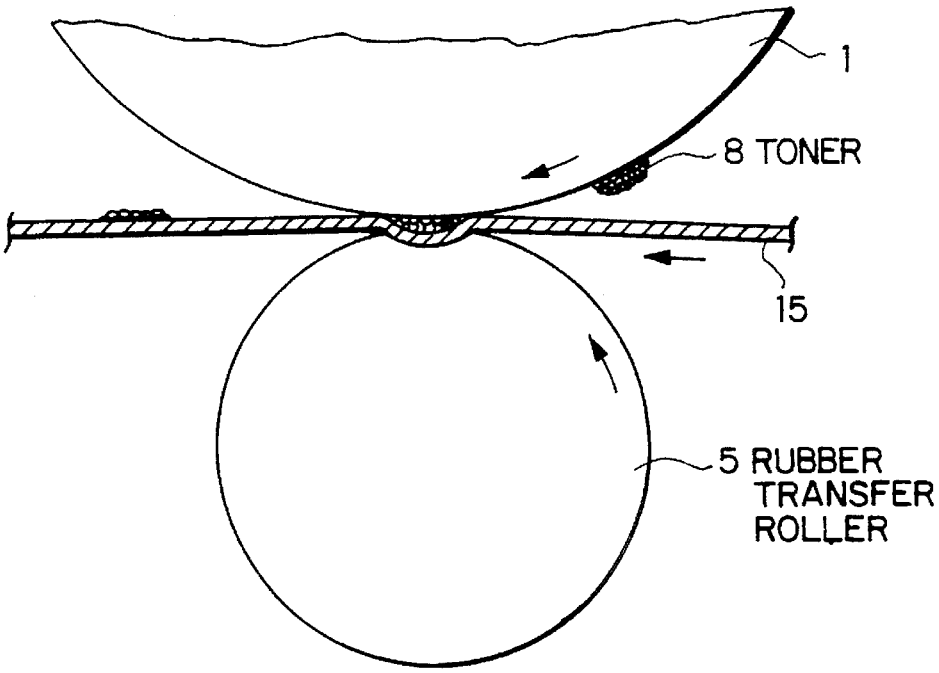
FIG. 14 is a schematic view showing an embodiment of the transfer roller.
Figure 20A:
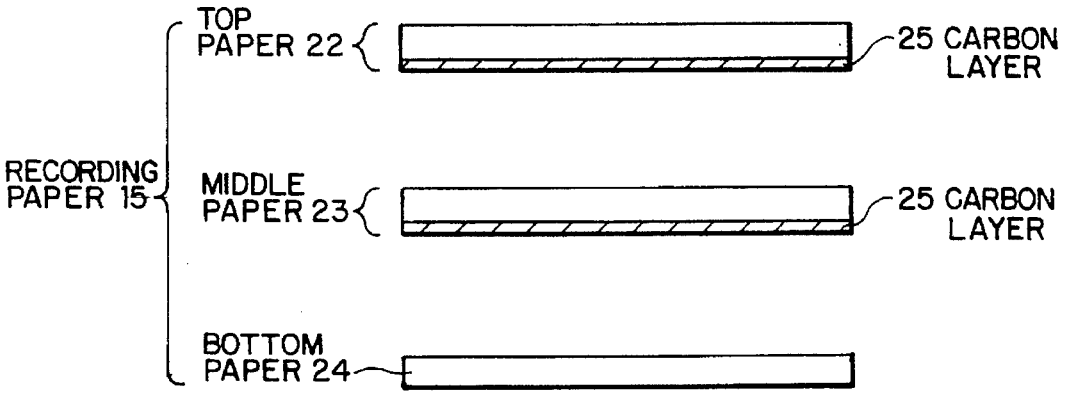
FIG. 20 is a schematic view showing the construction of recording paper using carbon paper.
Figure 20B:
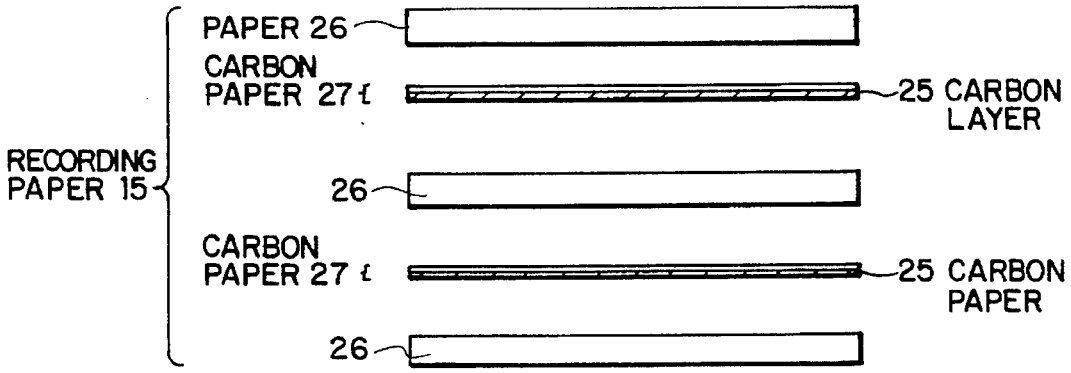

In the embodiment shown in FIG. 14, the transfer roller 5 of the magnetic printing apparatus is formed of a rubber material with a rubber hardness of 30 to 80. As described above, the latent image carrier 1 is hard drum-formed. The rubber material includes silicone rubber, fluororubber, urethane rubber, chlorinated polyethylene, butadiene rubber, styrene-butadiene rubber, isoprene rubber, natural rubber, and the like. The recording paper 15 can be various types as shown in FIG. 19 or FIG. 20. When carbonless paper is used, the compressive strengths of the toner 8 and the microcapsules constituting the color former 20 of the recording paper 15 are adjusted so that the former is greater than the latter. The toner 8 can be any of the above-described double-layered structure type of the shell 81 and the core 82 and those of the single-layered type. As described in FIGS. 9 to 11, sprockets 501 are provided at both ends of the transfer roller 5 to prevent a vertical deviation of the recording paper 15. In this connection, it is adapted so that the latent image carrier 1 does not contact the sprocket 501. In the present embodiment, the clearance d as shown in FIG. 1 or FIG. 4 is not always required, and the latent image carrier 1 may contact the transfer roller 5.

In operation, the image visualized by the developer 4 is transferred to the recording paper 15 by the transfer roller 5. Since the toner 8 transferred to the recording paper 15 is plastically deformed by a pressure, but does not penetrate deep into the fibers of the recording paper 15, it is melted by thermal fixing to penetrate into the fibers, where it is securely fixed. During the transfer, in the transfer unit, the toner 8, together with the recording paper 15, is pressed between the latent image carrier 1 and the transfer roller 5 and, during the pressurization, the pressure is higher at the portion where the toner 8 exists than a portion where the toner 8 does not exist to an extent according to the height of the toner. Therefore, for example, the microcapsules are broken by a pressure generated at the portion where the toner 8 exists, thereby achieving copying at this portion. Although a pressure is applied also to the portion where the toner 8 does not exist, the transfer roller 5, which is an elastic body formed of a rubber material, deforms, and the pressure does not increase to a value that can break the microcapsules and, as a result, copying is not made at the portion where the toner 8 does not exist. If the rubber hardness of the transfer roller 5 is smaller than 30, the pressure is insufficient also at the portion where the toner 8 exists, or if the rubber hardness is higher than 80, the overall pressure of the recording paper 15 is too high, causing copying over the entire surface, both of which are not preferable.

Figure 15:
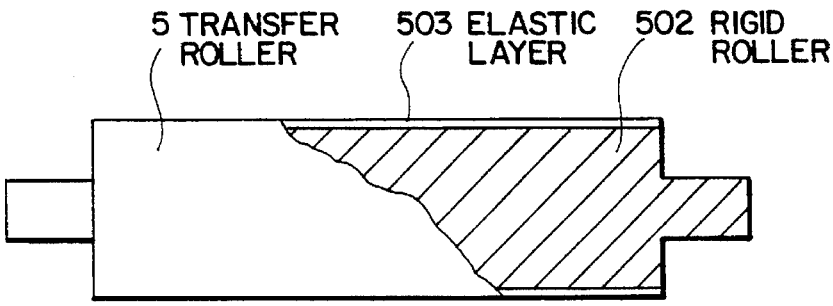
FIG. 15 is a schematic view showing another embodiment of the transfer roller.

In an embodiment shown in FIG. 15, the transfer roller 5 of the printing apparatus shown in FIG. 1 is formed of a rigid roller 502 and an elastic layer 503 on the surface. As described above, the latent image carrier 1 is of a hard drum-formed one. The material of the rigid roller 502 includes aluminum alloys, copper alloys, ferrous alloys such as carbon steel and chromium-molybdenum steel, ceramics such as silicon nitride, zirconia, and silicon carbide, resins reinforced with carbon fibers or aramide fibers. Metallic materials are superior in processability but are relatively small in Young's modulus and hardness, whereas ceramic materials are inferior in processability but are high in Young's modulus and hardness. These materials preferably have a Young's modulus of 100 GPa or more. The elastic layer 503 is required to be easily deformable and high in frictional force with recording paper 15. Such a material includes natural rubber, synthetic natural rubber, chloroprene rubber, styrene-butadiene rubber, butadiene rubber, nitrile rubber, butyl rubber, ethylene-propylene rubber, acrylic rubber, urethane rubber, silicone rubber, fluorosilicone rubber, fluororubber, chlorosulfonated polyethylene, chlorinated polyethylene, and the like. These materials can be coated on the rigid roller 502, molded or expansion molded, or emboss molded on the rigid roller 502 to form the elastic layer 503. The toner 8 can be various types including those of the above-described double-layered type and single-layered type but, preferably, those dispersed with rigid particles of an average particle diameter of 5 to 70 μm such as magnetic particle 83 shown in FIG. 16.

Specifically, the toner 8 basically comprises a binder and magnetic particles 83 and, as necessary, a coloring agent, a charge control agent, conductivity control agent, a fluidizing agent, an IR absorber, a release agent, or a dispersant is added internally or externally. The binder includes polystyrene resin, polyethylene resin, polyester resin, styrene-acrylic copolymer resin, polyolefin resin, ethylene-vinylacetate copolymer resin, bisphenol A type epoxy resin, polyamide resin, and wax, which can be used alone or as mixtures. The magnetic particle 83 is preferably a magnetic material including oxides such as $\gamma$-$Fe_2O_3$, Co-$\gamma$-$Fe_2O_3$, Ba ferrite, $Fe_3O_4$, $CrO_2$, and Co—$FeO_2$; nitrides such as $Fe_2N$; elements or alloys of iron, cobalt, and nickel; a compound. The magnetic particle 83 is uniformly dispersed in a resin. The more the content of the magnetic particle, the better the magnetic characteristics, but since excessive amounts of the magnetic particle result in degradation of transferability and fixability, and a content of 10 to 70 wt % is preferable. The content of the magnetic particle 83 is limited because, as the magnetic particle content increases, the specific gravity of the toner 8 becomes higher, effect of gravity becomes higher compared to the magnetic attractive force, and development cannot be carried out smoothly. Depending on the resolution of the printing apparatus, the average particle diameter of the toner 8 is preferably 30 to 150 μm.

Furthermore, the thickness of the elastic layer 503 is smaller than the average particle diameter of the magnetic particles (rigid particles) 83.

Figure 16:
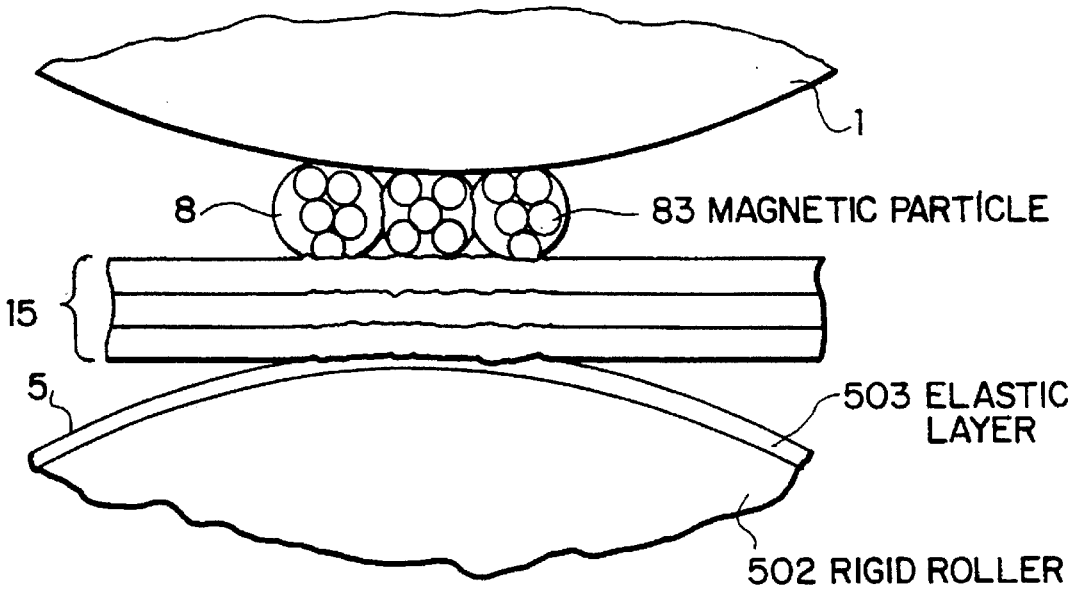
FIG. 16 is a schematic view showing an example of the toner.

Under the above-described condition, when a stack of three sheets of copyable pressure-sensitive paper shown in FIG. 10 or FIG. 19 is fed as the recording paper 15, the toner 8 is transferred to a top paper 16 and, since it is passed between the latent image carrier 1 and the transfer roller 5, a pressure is generated, the toner 8 is plastically deformed and presses the top paper 16, a middle paper 17, and a bottom paper 18. This condition is shown in FIG. 16. The pressure at this moment breaks the microcapsules of the color former 20 coated on the back side of the middle paper 17 and the bottom paper 18, and a dye contained therein comes out to develop a color, thereby achieving copying. The copying mechanism is not limited to the stack of three sheets of pressure-sensitive paper, but a stack of two sheets of paper includes only the top paper 16 and the bottom paper 18, and for a stack of four or more sheets of paper, only the sheets of the middle paper are increased. When the pressure applied by the toner 8 and the height a of the toner 8 are large, an increased number of sheets of pressure-sensitive paper can be copied. When the elastic layer 503 of the transfer roller 5 is thick, a pressure is applied also to the portion other than the image portion by the toner 8 to develop a color, resulting in spotting of the substrate. On the other hand, when the thickness of the elastic layer 503 is smaller than the average particle diameter of the rigid particles such as the magnetic particles 83, the elastic layer 503 absorbs the plastic deformation of the toner 8 and overlapping of the recording paper 15 to some extent, but the rigid particles such as the magnetic particles 83 are pressed by the rigid roller 502 to transmit the pressure to the recording paper 15, achieving copying. In this case, the pressure is hard to be transmitted to the non-image area, and a high-quality copy image with reduced substrate staining is obtained. Also in this case, the recording paper 15 can be those of various types as shown in FIG. 20, in addition to those shown in FIG. 19. When carbonless paper is used, the compressive strengths of the toner 8 and the microcapsules constituting the color former 20 of the recording paper 15 are adjusted so that the former is greater than the latter. The toner 8 can be any of the above-described double-layered structure type of the shell 81 and the core 82 and those of the single-layered type. As described in FIGS. 9 to 11, sprockets 501 are provided to prevent a vertical deviation of the recording paper 15. In this connection, it is adapted so that the latent image carrier 1 does not contact the sprocket 501. In the present embodiment, the clearance d as shown in FIG. 1 or FIG. 4 is not always required, and the latent image carrier 1 may contact the transfer roller 5.

In an embodiment described below, one of the two pressure rollers **56*a* and 56*b* of the electrophotographic printing apparatus shown in FIG. 12, for example, the lower pressure roller 56*b*, is formed of a rubber material as the transfer roller 5 shown in FIG. 14. Or, the roller 56*b* is formed of a rigid roller and an elastic layer as in the transfer roller 5 shown in FIG. 15 and FIG. 16. In any case, the other pressure roller 56*a* may be a rigid roller. The present embodiment also does not always require a clearance d as shown in FIG. 12 and FIG. 4, but the two pressure rollers 56***a* and 56*b* may contact each other. Furthermore, as described in FIG. 12, sprockets 561 are provided at both ends of the pressure roller 56*a* or 56*b* to prevent a vertical deviation of the recording paper, and the pressure roller with no sprocket must be prevented from contacting the sprocket 561.

For example, also for a case where the pressure roller 56*b* is formed of a rigid roller and its surface elastic layer, as described above, it is preferable to use the toner 59 dispersed with rigid particles of an average particle diameter of 5 to 70 μm, and that the thickness of the elastic layer of the pressure roller 56*b* is smaller than the average particle diameter of the rigid particles. Under such a condition, when, for example, the recording paper 15 comprising a stack of three sheets of copyable pressure-sensitive paper shown in FIG. 10 or FIG. 19 is fed, the top paper 16 is transferred with the toner 59, and then pressed between the pressure rollers 56*a* and 56*b* to generate a pressure, and the toner 59, while being plastically deformed, presses the top paper 16, the middle paper 17, and the bottom paper 18. When the pressure at this moment destroys the microcapsules of the color former 20 coated on the back side of the middle paper 17 and the bottom paper 18, and the dye contained therein comes out to develop a color, thereby enabling copying. This copy mechanism is not limited to the stack of three sheets of pressure-sensitive paper, but a stack of two sheets of paper includes only the top paper 16 and the bottom paper 18, and for a stack of four or more sheets of paper, only the sheets of the middle paper are increased. The greater the pressure applied by the toner 59 and the height a of the toner 59, the more sheets of pressure-sensitive paper can be copied. When the elastic layer of the transfer roller 56*b* is thick, a pressure is applied also to the portion other than the image portion by the toner 8 to develop a color, resulting in staining of the substrate. On the other hand, when the thickness of the elastic layer is smaller than the average particle diameter of the rigid particles, the elastic layer absorbs the plastic deformation of the toner 59 and overlapping of the recording paper 15 to some extent, but the rigid particles are pressed by the rigid roller to transmit the pressure to the recording paper 15, achieving copying. Also in this case, the pressure is hard to be transmitted to the non-image area, and a high-quality copy image with reduced substrate staining is obtained. In this case, the recording paper 15 can be those of various types as shown in FIG. 20, in addition to those shown in FIG. 19. When carbonless paper is used, the compressive strengths of the toner 59 and the microcapsules constituting the color former 20 of the recording paper 15 are set so that the former is greater than the latter.

In an embodiment described below, one of the first and second transfer rollers 55 and 60 of the electrophotographic printing apparatus shown in FIG. 13, for example, the second transfer roller 60, is formed of a rubber material as the transfer roller 5 shown in FIG. 14. Or, the roller 60 is formed of a rigid roller and an elastic layer as in the transfer roller 5 shown in FIG. 15 and FIG. 16. In any case, the other transfer roller 55 may be a rigid roller. The present embodiment also does not always require a clearance d as shown in FIG. 13 and FIG. 4, but the transfer rollers 55 and 60 may contact each other. Furthermore, as described in FIG. 13, sprockets 601 are provided at both ends of the one transfer roller to prevent a vertical deviation of the recording paper 15, and the pressure roller with no sprocket from contacting the sprocket 601.

For example, also for a case where the pressure roller 60 is formed of a rigid roller and its surface elastic layer, as described above, it is preferable to use the toner 59 dispersed with rigid particles of an average particle diameter of 5 to 70 μm., and that the thickness of the elastic layer of the second transfer roller 60 is smaller than the average particle diameter of the rigid particles. Under such a condition, when, for example, the recording paper 15 comprising a stack of three sheets of copyable pressure-sensitive paper shown in FIG. 10 or FIG. 19 is fed, the top paper 16 is transferred with the toner 59, and then pressed between the first and second transfer rollers 55 and 56 to generate a pressure, and the toner 59, while being plastically deformed, presses the top paper 16, the middle paper 17, and the bottom paper 18. When the pressure at this moment destroys the microcapsules of the color former 20 coated on the back side of the middle paper 17 and the bottom paper 18, the dye contained therein comes out to develop a color, thereby enabling copying. This copy mechanism is not limited to the stack of three sheets of pressure-sensitive paper, but a stack of two sheets of paper includes only the top paper 16 and the bottom paper 18, and for a stack of four or more sheets of paper, only the sheets of the middle paper 17 are increased. The greater the pressure applied by the toner 59 and the height a of the toner 59, the more sheets of pressure-sensitive paper can be copied. When the elastic layer of the transfer roller 60 is thick, a pressure is applied also to the portion other than the image portion by the toner 59 to develop a color, resulting in staining of the substrate. On the other hand, when the thickness of the elastic layer is smaller than the average particle diameter of the rigid particles, the elastic layer absorbs the plastic deformation of the toner 59 and overlapping of the recording paper 15 to some extent, but the rigid particles are pressed by the rigid roller to transmit the pressure to the recording paper 15, achieving copying. Also in this case, the pressure is hard to be transmitted to the non-image area, and a high-quality copy image with reduced substrate staining is obtained. In this case, the recording paper 15 can be those of various types as shown in FIG. 19 or FIG. 20. When carbonless paper is used, the compressive strengths of the toner 59 and the microcapsules constituting the color former 20 of the recording paper 15 are set so that the former is greater than the latter.

In the above-described embodiments, the latent image carrier 1 is drum-formed, however, it is not limited to this type, but may be of an endless belt type or the like.

Figure 17:
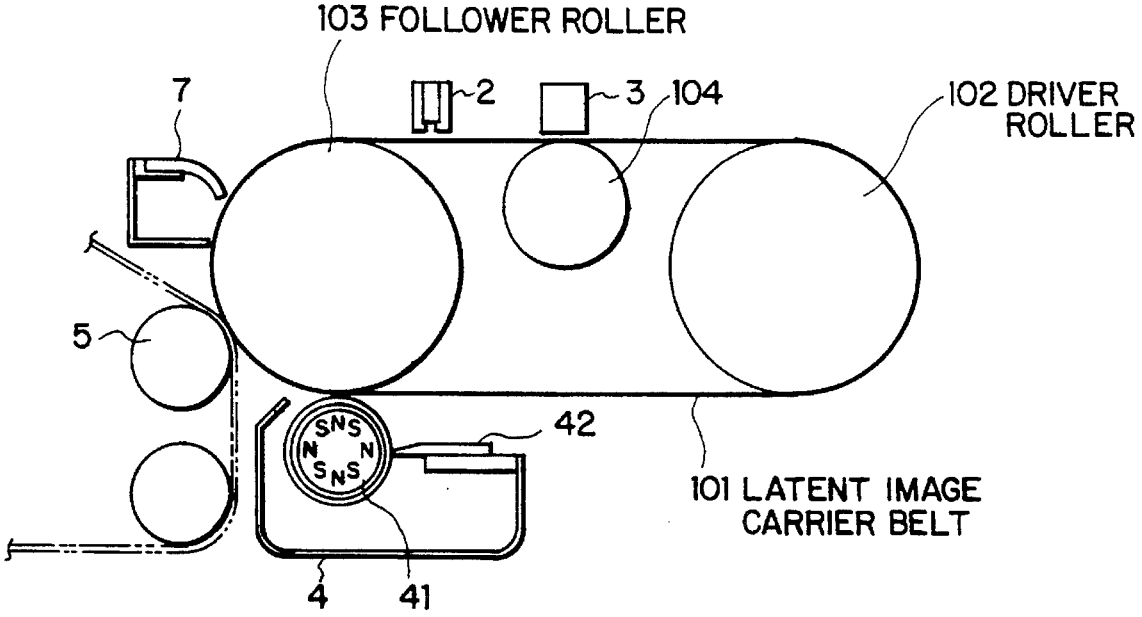
FIG. 17 is a schematic view showing an embodiment of the printing apparatus using an elastic belt-formed latent image carrier.
Figure 18:
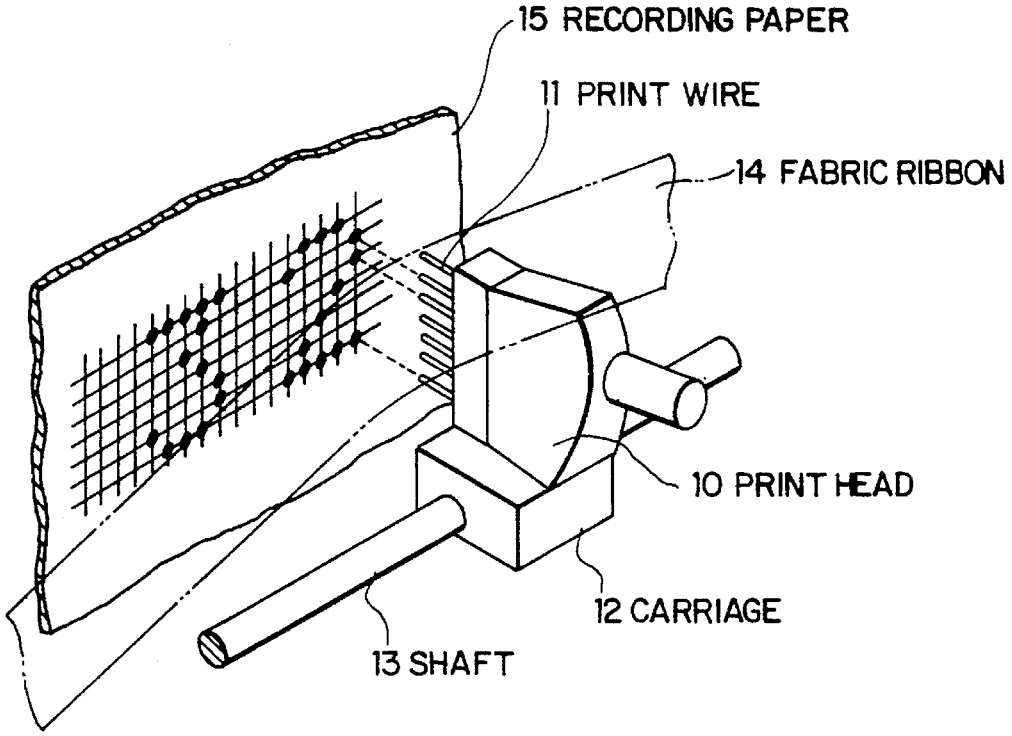
FIG. 18 is a schematic view showing the image formation mechanism of an impact dot matrix printing apparatus.

An embodiment shown in FIG. 17 uses an endless belt type latent image carrier, i.e. a latent image belt, 101 having an elasticity to construct a magnetic printing apparatus. In the latent image belt 101 shown in FIG. 17, a magnetic recording layer is formed on a belt formed with a nonmagnetic layer on a Ni plated belt having an elasticity, or is formed on an Al-deposited resin film belt, and a protective film is formed on the magnetic recording layer. The latent image belt 101 having an elasticity is rotated by a driver roller 102 and a follower roller 103 made of a non-magnetic metal. A demagnetizer 2 as a latent image eraser, the magnetic head 3 forming the latent image former, the developer 4, the transfer roller 5, the fixer 6, and the cleaner 7 are disposed in this order around the elastic latent image belt 101. A holding roller 104 is disposed opposing the magnetic head 3 across the latent image belt 101. In FIG. 17, the numeral 15 indicate recording paper, the numeral 41 indicates a magnet roller, and the numeral 42 indicates a doctor blade.

INDUSTRIAL APPLICABILITY

The present invention is useful for the printing apparatus used as an output unit of computers and the like, which does not generate big noise as seen in an impact dot matrix type printing apparatus, and enables printing and copying simultaneously.

We claim:

1. A printing method used for a printing apparatus having a latent image carrier, comprising the steps of:

erasing an exiting latent image from said forming a latent image on said carrier, developing said latent image on said carrier, transferring said latent image onto a stack of at least two sheets of pressure-sensitive paper being fed and transported through said printing apparatus and discharged therefrom, so that said latent image copies onto a lowest said recording paper of said stack, and fixing said latent image transferred onto said stack.

2. The printing method of claim 1 wherein the development is made by a single-component dry developing method, and a toner has an average particle diameter of 30 to 150 μm.

3. The printing method of claim 2 wherein the transfer is made by a pressure transfer method with a transfer pressure of 5 kgf/cm or more in load per unit roller length.

4. The printing method of claim 2 wherein the transfer is made by an electrostatic transfer method, and a pressurizing mechanism is used to apply a pressure of 5 kgf/cm or more in load per unit roller length to an image on the recording paper in addition to the transfer and the fixing.

5. A printing method used for a printing apparatus having a latent image carrier, comprising the steps of:

erasing an existing latent image from said carrier, forming a latent image on said carrier using a toner, developing said latent image on said carrier, transferring said latent image onto a stack of plural sheets of pressure-sensitive paper, which develops a color image by a reaction of a color developer with a dye in microcapsules in the sheets, being fed and transported through said printing apparatus and discharged therefrom, so that said latent image copies onto a lowest of said sheets of said stack, and fixing said latent image transferred onto said stack, said toner having a greater compressive strength than that of the microcapsules .

6. A printing apparatus comprising a latent image carrier, a latent image eraser for erasing a latent image on said latent image carrier, a latent image former for forming a latent image on said latent image carrier, a developer for developing the latent image on said latent image carrier to an image by an aggregate of toners, a transfer roller for transferring the image on said latent image carrier to copyable recording paper comprising a stack of plural sheets sensitive to a pressure so that the image is copied onto all of said sheets, a fixer for fixing the image on the recording paper, and a cleaner for removing said toner remaining on said latent image carrier after pressure transfer, characterized by a relation of $t/4 \leqq d \leqq t+a$, wherein d is a clearance between said latent image carrier and said transfer roller, t is a total thickness of the recording paper, and a is a height of said toner on said latent image carrier, and the recording paper being passed through a clearance between said latent image carrier and said transfer roller.

7. The printing apparatus of claim 6 wherein rings rotatable independent of said transfer roller are provided at both ends of said transfer roller, and said clearance is maintained between said latent image carrier and said transfer roller when said latent image carrier is in contact with said rings.

8. The printing apparatus of claim 6 wherein said toner has a structure of at least two layers comprising a core part and a shell part, the core part has an elastic modulus higher than that of the shell part, and said latent image carrier and said transfer roller are formed of a substance having a Vickers hardness of 50 or more.

9. A printing apparatus comprising a latent image eraser for erasing a latent image on a latent image carrier, a latent image former for forming a latent image on said latent image carrier, a developer for developing the latent image on said latent image carrier to an image by an aggregate of toners, a transfer roller for transferring the image on said latent image carrier to copyable recording paper comprising a stack of plural sheets sensitive to a pressure so that the image is copied onto all of said sheets, two pressure rollers for pressurizing the recording paper after transfer, a fixer for fixing the image on the recording paper, and a cleaner for removing said toner remaining on said latent image carrier after pressure transfer, characterized by a relation of $t/4 \leqq d \leqq t+a$, wherein d is a clearance between said two pressure rollers, t is a total thickness of the recording paper, and a is a height of said toner on said recording paper, and the recording paper being passed through a clearance between said latent image carrier and said transfer roller and a clearance between said two pressure rollers.

10. The printing apparatus of claim 9 wherein said toner has a structure of at least two layers comprising a core part and a shell part, the core part has an elastic modulus higher than that of the shell part, and said two pressure rollers are formed of a substance having a Vickers hardness of 50 or more.

11. A printing apparatus comprising a latent image eraser for erasing a latent image on a latent image carrier, a latent image former for forming a latent image on said latent image carrier, a developer for developing the latent image on said latent image carrier to an image by an aggregate of toners, a first transfer roller for transferring the image on said latent image carrier to itself, and a second transfer roller for pressure transferring the image on said first transfer roller to copyable recording paper comprising a stack of plural sheets sensitive to a pressure, a fixer for fixing the image on the recording paper, and a cleaner for removing said toner remaining on said latent image carrier after pressure transfer, characterized by a relation of $t/4 \leqq d \leqq t+a$, wherein d is a clearance between said first and second transfer rollers, t is a total thickness of the recording paper, and a is a height of said toner on said first transfer roller, and the recording paper being passed through a clearance between said first and second transfer rollers.

12. The printing apparatus of claim 11 wherein said toner has a structure of at least two layers comprising a core part and a shell part, the core part has an elastic modulus higher than that of the shell part, and said first and second transfer rollers are formed of a substance having a Vickers hardness of 50 or more.

13. The printing apparatus of claim 8 or claim 10 or claim 12 wherein the core part of said toner is a magnetic material, and the shell part is a resin.

14. The printing apparatus of claim 6 or claim 9 or claim 11 wherein the height a of said-toner is 30 μm or more.

15. A printing apparatus comprising a latent image carrier, a latent image eraser for erasing a latent image on a latent image carrier, a latent image former for forming a latent image on said latent image carrier, a developer for developing the latent image on said latent image carrier to an image by an aggregate of toners, a transfer roller for pressurizing a recording paper between said roller and said latent image carrier so that the image on said latent image carrier is pressure transferred to said recording paper comprising a stack of plural sheets sensitive to a pressure, a fixer for fixing the image on the recording paper, and a cleaner for removing the toner remaining on the latent image carrier after pressure transfer, said transfer roller being formed of a rubber material having a rubber hardness of 30 to 80.

16. A printing apparatus comprising a latent image carrier, a latent image eraser for erasing a latent image on a latent image carrier, a latent image former for forming a latent image on said latent image carrier, a developer for developing the latent image on said latent image carrier to an image by an aggregate of toners, a transfer roller for pressurizing a recording paper between said roller and said latent image carrier so that the image on said latent image carrier is pressure transferred to the recording paper comprising a stack of plural sheets sensitive to a pressure, a fixer for fixing the image on the recording paper, and a cleaner for removing the toner remaining on the latent image carrier after pressure transfer, said transfer roller comprising a rigid roller and an elastic layer, and rigid particles with an average particle diameter of 5 to 70 μm being dispersed in said toner.

17. The printing apparatus of claim 6 or claim 15 or claim 16 wherein a sprocket with projections disposed at predetermined intervals in the circumferential direction is provided at both ends of said transfer roller.

18. The printing apparatus of claim 17 wherein a length of said latent image carrier is shorter than a distance between the sprockets at both ends of said transfer roller.

19. The printing apparatus of claim 18 wherein said latent image carrier is drum-formed, and has a smaller outer diameter at both ends than the outer diameter of a central portion.

20. A printing apparatus comprising a latent image eraser for erasing a latent image on a latent image carrier, a latent image former for forming a latent image on said latent image carrier, a developer for developing the latent image on said latent image carrier to an image by an aggregate of toners, a transfer roller for transferring the image on said latent image carrier to copyable recording paper comprising a stack of plural sheets sensitive to a pressure, two pressure rollers for pressurizing the recording paper after transfer, a fixer for fixing the image on the recording paper, and a cleaner for removing said toner remaining on said latent image carrier after pressure transfer, characterized in that one of said pressure rollers is formed of a rubber material having a rubber hardness of 30 to 80.

21. A printing apparatus comprising a latent image eraser for erasing a latent image on a latent image carrier, a latent image former for forming a latent image on said latent image carrier, a developer for developing the latent image on said latent image carrier to an image by an aggregate of toners, a transfer roller for transferring the image on said latent image carrier to copyable recording paper comprising a stack of plural sheets sensitive to a pressure, two pressure rollers for pressurizing the recording paper after transfer, a fixer for fixing the image on the recording paper, and a cleaner for removing said toner remaining on said latent image carrier after pressure transfer, characterized in that one of said pressure rollers comprises a rigid roller and an elastic layer, and rigid particles with an average particle diameter of 5 to 70 μm are dispersed in said toner.

22. The printing apparatus of claim 9 or claim 20 or claim 21 wherein a sprocket with projections disposed at predetermined intervals in the circumferential direction is provided at both ends of one of said two pressure rollers.

23. The printing apparatus of claim 22 wherein a length of the other pressure roller is shorter than a distance between the sprockets at both ends of said one pressure roller.

24. The printing apparatus of claim 23 wherein the other pressure roller has a smaller outer diameter at both ends than the outer diameter of a central portion.

25. A printing apparatus comprising a latent image eraser for erasing a latent image on a latent image carrier, a latent image former for forming a latent image on said latent image carrier, a developer for developing the latent image on said latent image carrier to an image by an aggregate of toners, a first transfer roller for transferring the image on said latent image carrier to itself, and a second transfer roller for pressurizing a recording paper between said second transfer roller and said first transfer roller so that the image on said latent image carrier is pressure transferred to the copyable recording paper comprising a stack of plural sheets sensitive to a pressure, a fixer for fixing the image on the recording paper, and a cleaner for removing the toner remaining on the latent image carrier after pressure transfer, one of said first transfer roller and said second transfer roller being formed of a rubber material having a rubber hardness of 30 to 80.

26. A printing apparatus comprising a latent image eraser for erasing a latent image on a latent image carrier, a latent image former for forming a latent image on said latent image carrier, a developer for developing the latent image on said latent image carrier to an image by an aggregate of toners, a first transfer roller for transferring the image on said latent image carrier to itself, and a second transfer roller for pressurizing a recording paper between said second transfer roller and said first transfer roller so that the image on said latent image carrier is pressure transferred to the copyable recording paper comprising a stack of plural sheets sensitive to a pressure, a fixer for fixing the image on the recording paper, and a cleaner for removing the toner remaining on the latent image carrier after pressure transfer, one of said first and second transfer rollers comprising a rigid roller and an elastic layer, and rigid particles with an average particle diameter of 5 to 70 μm being dispersed in said toner.

27. The printing apparatus of claim 11 or claim 25 or claim 26 wherein a sprocket with projections disposed at predetermined intervals in the circumferential direction is provided at both ends of one of said first and second transfer rollers.

28. The printing apparatus of claim 27 wherein a length of the other transfer roller is shorter than a distance between the sprockets at both ends of said one transfer roller.

29. The printing apparatus of claim 28 wherein the other transfer roller has a smaller outer diameter at both ends than the outer diameter of a central portion.

30. The printing apparatus of claim 16 or claim 21 or claim 26 wherein the rigid particles are magnetic particles.

31. The printing apparatus of claim 30 wherein the elastic layer has a thickness smaller than an average particle diameter of the rigid particles.

32. The printing apparatus of claim 31 wherein the rigid roller has a Young's modulus of 100 GPa or more.

33. The printing apparatus of claim 6 or claim 9 or claim 11 or claim 15 or claim 16 or claim 20 or claim 21 or claim 25 or claim 26 wherein the recording paper is a stack of plural sheets of pressure-sensitive paper capable of developing a color by a reaction of a color developer and a dye in microcapsules, and has a compressive strength greater than that of the microcapsules.

34. The printing apparatus of claim 6 or claim 9 or claim 11 or claim 15 or claim 16 or claim 20 or claim 21 or claim 25 or claim 26 wherein said developer is a single-component dry developer.

35. The printing apparatus of claim 6 or claim 15 or claim 16 wherein a transfer pressure in the pressure transfer is 5 kgf/cm or more in load per unit roller length.

36. The printing apparatus of claim 9 or claim 20 or claim 21 wherein a pressure of said two pressure rollers is 5 kgf/cm or more in load per unit roller length.

37. The printing apparatus of claim 11 or claim 25 or claim 26 wherein a pressure of said first and second transfer rollers is 5 kgf/cm or more in load per unit roller length.

* * * * *

UNITED STATES PATENT AND TRADEMARK OFFICE

CERTIFICATE OF CORRECTION

PATENT NO. : 5,489,967
DATED : February 6, 1996
INVENTOR(S) : Sakagami et al.

It is certified that error(s) appears in the above-identified patent and that said Letters Patent is hereby corrected as shown below:

On the cover page, in part 22, PCT filed:, delete "Nov. 20, 1993" and insert --Jan. 20, 1993--.

Signed and Sealed this

Twenty-fifth Day of February, 1997

*Attest:*

Bruce Lehman

BRUCE LEHMAN

*Attesting Officer*

*Commissioner of Patents and Trademarks*